US009576718B2

(12) United States Patent
Jow et al.

(10) Patent No.: US 9,576,718 B2
(45) Date of Patent: Feb. 21, 2017

(54) INDUCTOR STRUCTURE IN A SEMICONDUCTOR DEVICE

(71) Applicant: QUALCOMM Incorporated, San Diego, CA (US)

(72) Inventors: Uei-Ming Jow, San Jose, CA (US); Young Kyu Song, San Diego, CA (US); Jong-Hoon Lee, San Diego, CA (US); Jung Ho Yoon, Irvine, CA (US); Sangjo Choi, San Diego, CA (US); Xiaonan Zhang, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 14/746,652

(22) Filed: Jun. 22, 2015

(65) Prior Publication Data

US 2016/0372253 A1 Dec. 22, 2016

(51) Int. Cl.
*H01F 27/28* (2006.01)
*H01F 5/00* (2006.01)
*H01F 41/04* (2006.01)

(52) U.S. Cl.
CPC ..... *H01F 27/2804* (2013.01); *H01F 41/041* (2013.01); *H01F 2027/2809* (2013.01)

(58) Field of Classification Search
CPC ..... H01F 27/28; H01F 27/2804; H01F 41/04; H01F 41/041; H01F 5/003; H01F 17/0006; H01F 17/0013; H01F 2027/2809
USPC ..... 336/200, 222–225; 29/602.1; 257/531
See application file for complete search history.

(56) References Cited

U.S. PATENT DOCUMENTS

| | | | | |
|---|---|---|---|---|
| 6,291,872 | B1 | 9/2001 | Wang et al. | |
| 6,549,112 | B1 | 4/2003 | Gallina et al. | |
| 6,803,848 | B2 | 10/2004 | Yeo et al. | |
| 7,088,215 | B1 * | 8/2006 | Winter | H01F 17/0033 29/602.1 |
| 7,170,384 | B2 | 1/2007 | Kim et al. | |
| 7,417,525 | B2 | 8/2008 | Lee et al. | |
| 7,667,566 | B2 | 2/2010 | Hsu et al. | |
| 7,928,824 | B2 * | 4/2011 | Jow | H01F 17/0013 336/200 |
| 7,948,346 | B2 | 5/2011 | Hebert et al. | |
| 7,971,340 | B2 | 7/2011 | Hebert et al. | |
| 8,686,821 | B2 | 4/2014 | Chang et al. | |
| 8,773,233 | B2 * | 7/2014 | Hazucha | H01F 17/0033 336/200 |

(Continued)

OTHER PUBLICATIONS

International Search Report and Written Opinion—PCT/US2016/036079—ISA/EPO—Sep. 5, 2016.

*Primary Examiner* — Mangtin Lian
(74) *Attorney, Agent, or Firm* — Toler Law Group, PC

(57) ABSTRACT

An inductor structure includes a first set of traces corresponding to a first layer of an inductor, a second set of traces corresponding to a second layer of the inductor, and a third set of traces corresponding to a third layer of the inductor that is positioned between the first layer and the second layer. The first set of traces includes a first trace and a second trace that is parallel to the first trace. A dimension of the first trace is different from a corresponding dimension of the second trace. The second set of traces is coupled to the first set of traces. The second set of traces includes a third trace that is coupled to the first trace and to the second trace. The third set of traces is coupled to the first set of traces.

30 Claims, 9 Drawing Sheets

(56) References Cited

U.S. PATENT DOCUMENTS

| | | | | |
|---|---|---|---|---|
| 2003/0043010 | A1* | 3/2003 | Yeo | H01L 28/10 336/200 |
| 2007/0090912 | A1 | 4/2007 | Lee | |
| 2009/0134503 | A1* | 5/2009 | Feng | H01F 17/0033 257/673 |
| 2015/0371764 | A1* | 12/2015 | Gordin | H01F 17/0013 336/225 |

* cited by examiner

INDUCTOR STRUCTURE IN A SEMICONDUCTOR DEVICE

I. FIELD

The present disclosure is generally related to an inductor structure(s).

II. DESCRIPTION OF RELATED ART

Semiconductor devices, such as radio frequency (RF) filters, may include an inductor. In many instances, the inductor may be used in combination with a capacitor. Performance of the inductor, such as indicated by a quality factor (Q), may be dependent on a configuration (e.g., a structure) of the inductor. A conventional inductor having a solenoid design having a relatively high quality factor may occupy a large area, which may increase the cost of manufacturing the inductor.

III. SUMMARY

The present disclosure describes formation and structures of inductors, such as solenoid inductors. An inductor may include multiple sets of traces that are each associated with a different layer of a semiconductor device. For example, an inductor may include three sets of traces and each set of traces may be associated with a different layer of the semiconductor device. At least one set of traces (or a sub-set of traces thereof) may have a tapered configuration. For example, traces of a particular set of traces may gradually increase in length and/or width. Additionally or alternatively, each trace of the particular set of traces may be parallel to other traces of the particular set of traces.

In some implementations, the multiple sets of traces may include a first set of parallel traces associated with a first layer of an inductor, a second set of non-parallel traces associated with a second layer of the inductor, and a third set of parallel traces associated with a third layer of the inductor. One or more of the multiple sets of traces may have the tapered configuration. The first set of parallel traces may overlap (in a vertical direction) the third set of parallel traces. In a particular implementation, a first trace of the first set of parallel traces at least partially overlaps a second trace of the third set of parallel traces. In some implementations, the first trace may completely overlap the second trace.

In an exemplary implementation, the multiple sets of traces may include a first set of traces and a second set of traces, and each trace of the first set of traces and of the second set of traces may include a sub-set of parallel traces and a sub-set of non-parallel traces. The sub-set of parallel traces of the first set of traces may be coupled to (and at least partially overlap) the sub-set of non-parallel traces of the second set of traces. The sub-set of parallel traces of the second set of traces may be coupled to (and at least partially overlap) the sub-set of non-parallel traces of the first set of traces. One or more of the sub-sets of traces may have the tapered configuration.

In some implementations, the tapered configuration may include a set of traces having different lengths and/or widths, which may improve an inductance and/or a quality factor (Q) of an inductor as compared to a conventional inductor in which lengths and/or widths of traces do not vary. For example, the tapered configuration may reduce a capacitance of the inductor structure, which may result in an improved quality factor (Q). Additionally, the inductor having the tapered configuration may have a reduced footprint as compared to the conventional inductor having a rectangular configuration, which may decrease manufacturing cost and render the inductor more suitable for mobile/embedded applications.

In a particular aspect, an inductor structure includes a first set of traces corresponding to a first layer of an inductor. The first set of traces includes a first trace and a second trace, where the first trace is parallel to the second trace. A dimension (e.g., length or width) of the first trace is different from a corresponding dimension of the second trace. The inductor structure further includes a second set of traces corresponding to a second layer of the inductor. The second set of traces is coupled to the first set of traces. The second set of traces includes a third trace that is coupled to the first trace and to the second trace. The semiconductor structure also includes a third set of traces corresponding to a third layer of the inductor. The third layer is positioned between the first layer and the second layer. The third set of traces is coupled to the first set of traces.

In another particular aspect, an apparatus includes a first means for conducting current corresponding to a first layer of an inductor. The first means for conducting current includes a first trace and a second trace, where the first trace is parallel to the second trace. A dimension of the first trace is different from a corresponding dimension of the second trace. The apparatus further includes a second means for conducting current corresponding to a second layer of the inductor. The second means for conducting current is coupled to the first means for conducting current. The second means for conducting current includes a third trace that is coupled to the first trace and to the second trace. The apparatus also includes a third means for conducting current corresponding to a third layer of the inductor. The third layer is positioned between the first layer and the second layer. The third means for conducting current is coupled to the first set of traces.

In another particular aspect, an inductor structure includes a first set of traces corresponding to a first layer of an inductor. The first set of traces includes a first sub-set of traces and a second sub-set of traces, where each trace of the first sub-set of traces is parallel to other traces of the first sub-set of traces. At least one trace of the second sub-set of traces is non-parallel to each trace of the first sub-set of traces. The inductor structure further includes a second set of traces corresponding to a second layer of the inductor. The second set of traces includes a third sub-set of traces and a fourth sub-set of traces. Each trace of the third sub-set of traces is parallel to other traces of the third sub-set of traces. At least one trace of the fourth sub-set of traces is non-parallel to each trace of the third sub-set of traces.

In another particular aspect, a method of forming an inductor structure includes forming a first set of traces corresponding to a first layer of an inductor. The first set of traces includes a first trace and a second trace, where the first trace is parallel to the second trace. A dimension of the first trace is different from a corresponding dimension of the second trace. The method further includes forming a second set of traces corresponding to a second layer of the inductor. The second set of traces is coupled to the first set of traces. The second set of traces includes a third trace that is coupled to the first trace and to the second trace. The method also includes forming a third set of traces corresponding to a third layer of the inductor. The third layer is positioned between the first layer and the second layer. The third set of traces is coupled to the first set of traces.

Other aspects, advantages, and features of the present disclosure will become apparent after review of the entire application, including the following sections: Brief Description of the Drawings, Detailed Description, and the Claims.

IV. BRIEF DESCRIPTION OF THE DRAWINGS

V. DETAILED DESCRIPTION

Particular aspects of the present disclosure are described below with reference to the drawings. In the description, common features are designated by common reference numbers.

Figure 1:
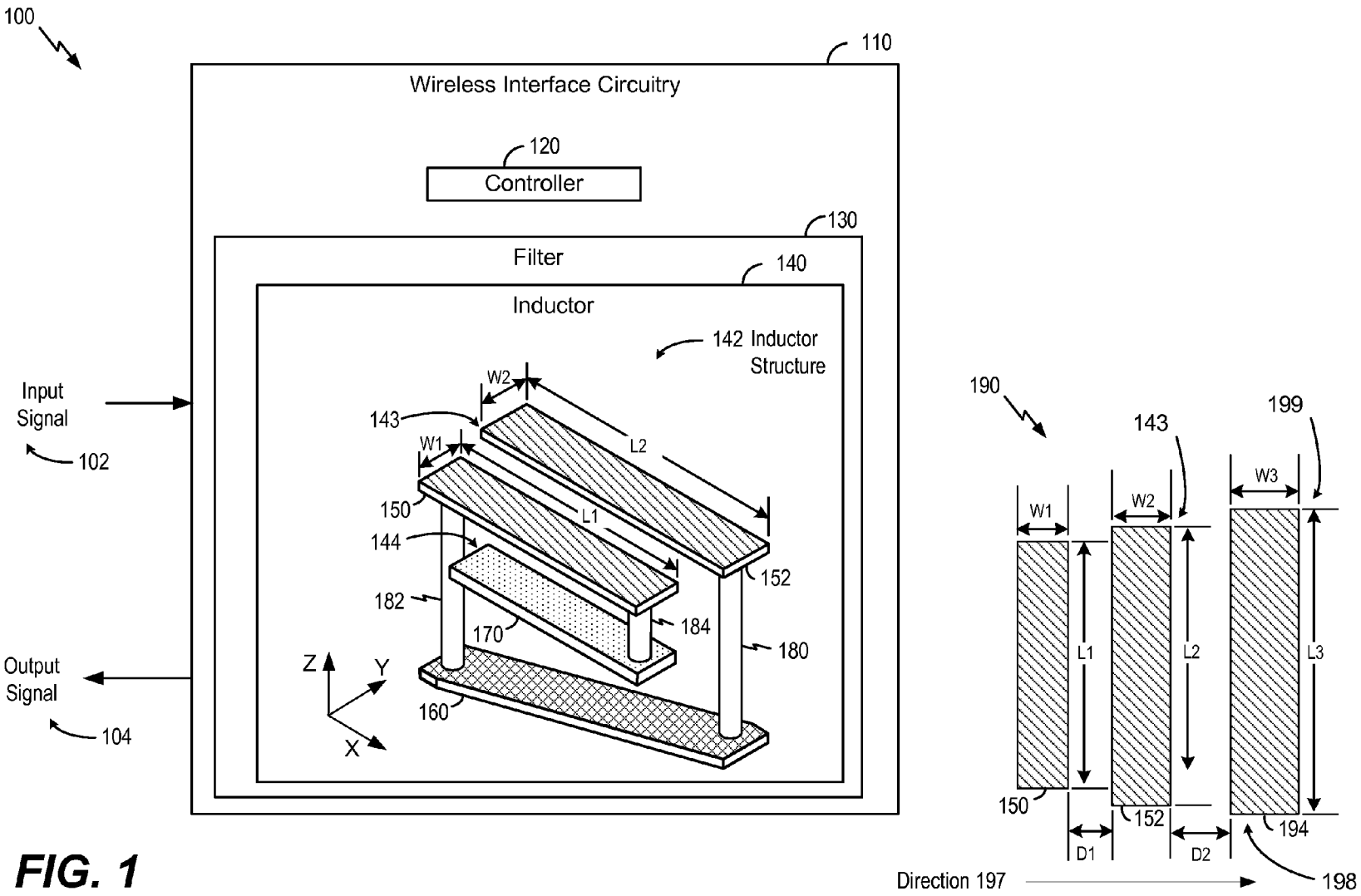
FIG. 1 is a block diagram of a particular illustrative aspect of system that includes an inductor.

Referring to FIG. 1, a first particular illustrative aspect of a system 100 is shown. The system 100 may include wireless interface circuitry 110 that is configured to process a radio frequency (RF) signal.

The wireless interface circuitry 110 may include a controller 120 and a filter 130, such as a RF filter. The controller 120 may be configured to control processing of one or more signals received by the wireless interface circuitry 110. The filter 130 may include an inductor 140, such as a solenoid inductor (e.g., a planar solenoid inductor). The inductor 140 may be associated with an inductor structure, such as a representative inductor structure 142. In some implementations, the wireless interface circuitry 110 may include one or more additional components, such as a capacitor, that may be coupled to the inductor 140.

The inductor structure 142 may include multiple sets of traces that are each associated with a different layer of the inductor 140, such as different layers of a semiconductor device that includes the inductor 140. For example, the inductor structure 142 may include at least a first set of traces associated with a first layer of the semiconductor device, a second set of traces associated with a second layer of the semiconductor device, and a third set of traces associated with a third layer of the semiconductor device. The third set of traces (e.g., the third layer) may be positioned between the first set of traces (e.g., the first layer) and the second set of traces (e.g., the second layer). In some implementations, the semiconductor device may include multiple semiconductor devices, such as a first semiconductor device that includes the first layer and a second semiconductor device that includes the second layer.

Each set of traces may include one or more traces. For example, the first set of traces may include a first trace 150 and a second trace 152, the second set of traces may include a third trace 160, and the third set of traces may include a fourth trace 170. Although each of the second set of traces and the third set of traces are illustrated as including a single trace, in other implementations, the second set of traces and/or the third set of trace may include multiple traces.

Traces of the inductor 140 may be coupled between different layers by connectors, such as a first connector 180, a second connector 182 and a third connector 184. A particular connector may include a via structure (e.g., a through silicon via (TSV) or a through glass via), a bump structure (e.g., a solder bump), or a combination thereof, as illustrative, non-limiting examples. Examples of connectors are described further herein with reference to FIG. 4.

The inductor 140 may include a first terminal and a second terminal. The first terminal may be coupled to first portion 143 of the second trace 152. The second trace 152 may be coupled to the third trace 160 by the first connector 180. The third trace 160 may be coupled to the first trace 150 by the second connector 182. The first trace 150 may be coupled to the fourth trace 170 by the third connector 184. A second portion 144 of the fourth trace 170 may be coupled to a second terminal.

The first trace 150 may be parallel to the second trace 152 on the first layer. For example, an edge surface of the first trace 150 may be parallel to a corresponding edge surface of the second trace 152. In some implementations, being parallel may include being parallel within one or more design tolerance, manufacturing tolerances, or a combination thereof. One or more traces of the second set of traces may be non-parallel with each trace of the first set of traces. For example, the third trace 160 may be non-parallel with the first trace 150 and with the second trace 152. In a particular implementation where the third set of traces includes multiple traces, each trace of the third set of traces (e.g., the fourth trace 170) may be parallel to traces of the second set of traces (e.g., the third trace 160). Additionally, each trace of the third set of traces may be parallel to each trace of the first set of traces. In some implementations, the third set of traces may have a tapered configuration.

The first trace 150 may have a first length (L1) and a first width (W1). The second trace 152 may have a second length (L2) and a second width (W2). The first length (L1) may be different from the second length (L2). Additionally or alternatively, the first width (W1) may be different from the second width (W2). In some implementations, the first set of traces may have a tapered configuration. Although not illustrated, each of the first trace 150 and the second trace 152 may have a corresponding height (e.g., a thickness). A first height of the first trace 150 may be the same as a second height of the second trace 152. In some implementations, a length of a particular trace may be greater than a width of the particular trace. Multiple traces (e.g., the first trace 150 and the second trace 152) may be positioned in a first direction, such as a direction corresponding to the y-axis of FIG. 1). The first direction may correspond to a width of each of the multiple traces. A second direction, that is perpendicular to the first direction, may correspond to a length of each of the multiple traces.

In some implementations, the first trace 150 may overlap (in the vertical direction) the fourth trace 170 associated with the third layer. In some implementations, the first trace 150 at least partially overlaps the fourth trace 170. In other implementations, the first trace 150 may overlap an entirety of the fourth trace 170.

Although the first set of traces of the inductor structure 142 is illustrated as having two traces, in other implementations, the first set of traces may include more than two traces, as depicted at 190. For example, the first set of traces may include the first trace 150, the second trace 152, and an additional trace 194. The second trace 152 may be positioned between the first trace 150 and the additional trace 194. The additional trace 194 may be parallel to each of the first trace 150 and the second trace 152. The additional trace 194 may have a third length (L3) and a third width (W3). The second length (L2) may be less than the third length (L3). Additionally or alternatively, the second width (W2) may be less than the third width (W3).

The first trace 150 may be spaced from the second trace 152 by a first distance (D1). The second trace 152 may be spaced from the additional trace 194 by a second distance (D2). In some implementations, the first distance (D1) may be less than the second distance (D2).

The first portion 143 of the second trace 152 may be coupled to a third portion 198 of the additional trace 194 by one or more connectors and/or one or more other traces. For example, the second set of traces associated with the second layer may include a particular trace (not shown) that is configured to couple the second trace 152 to the additional trace 194 (e.g., so that current flows through the inductor 140 up and down the layers of the semiconductor device including the inductor structure 142). If the second portion 143 of the second trace 152 is coupled to the third portion 198 of the additional trace 194, a fourth portion 199 of the additional trace 194 may be coupled to the first input of the inductor 140.

The first set of traces (e.g., the first trace 150, the second trace 152, and the additional trace 194) may have a tapered configuration. For example, with reference to a direction 197, a length of each trace of the first set of traces may be longer as compared to a previous trace. To illustrate, the second length (L2) may be longer than the first length (L1), and the third length (L3) may be longer than the second length (L2). Additionally or alternatively, with reference to the direction 197, a width of each trace of the first set of traces may be wider as compared to a previous trace. To illustrate, the second width (W2) may be wider than the first width (W1), and the third width (W3) may be wider than the second width (W2). Additionally or alternatively, with reference to the direction 197, a distance between a pair of adjacent traces of the first set of traces may increase as compared to a previous pair of adjacent traces. To illustrate, the second distance (D2) may be greater than the first distance (D1).

During operation of the system 100, wireless interface circuitry 110 (e.g., the controller 120) may receive an input signal 102. The input signal 102 may be associated with one or more electrical charges (e.g., charges provided in response to an alternating current (AC) voltage or a direct current (DC) voltage from a signal/power source). In some implementations, the input signal 102 (e.g., a charge) may correspond to a radio frequency (RF) signal to be filtered. The controller 120 may route the input signal 102 to one or more components (of the wireless interface circuitry 110), such as the filter 130 (e.g., the inductor 140). The input signal 102 may be processed (e.g., filtered) by the wireless interface circuitry 110 to generate an output signal 104. The controller 120 may cause the output signal 104 to be sent to a device or component coupled to the wireless interface circuitry 110. For example, the controller 120 may route the output signal 104 to a processor (not shown) coupled to the wireless interface circuitry 110 for additional processing.

Although the inductor 140 is illustrated as being included in the filter 130, in other implementations, the inductor 140 may be included in another component, such as a RF resonator. Additionally or alternatively, the inductor 140 may be included in a circuit or system other than the wireless interface circuitry 110. For example, the inductor 140 may be included in a digital circuit to decouple a capacitor of the digital circuit or may be included in a RF circuit to be matched with a capacitor of the RF circuit.

The inductor structure 142 may be formed using a wafer level package (WLP) process, a package on package (PoP) process, a land grid array (LGA) package process, a silicon process, a microelectromechanical systems (MEMS) process, and/or nano-technology, as illustrative, non-limiting examples. In some implementations, the inductor structure 142 may be included in a single package. For example, the inductor structure 142 may be formed using a single substrate. In other implementations, the inductor may be included in multiple packages. For example, the inductor 140 may be formed using multiple substrates. To illustrate, one or more layers (e.g., the first layer) of the inductor 140 may be formed using a first substrate and one or more other layers (e.g., the second layer and the third layer) of the inductor 140 may be formed using a second substrate. A first portion of the inductor 140 associated with the first substrate may be formed using a first process and a second portion of the inductor 140 associated with the second substrate may be formed using a second process that is the same as or different from the first process.

Although the inductor 140 has been described as having the inductor structure 142, in other implementations, the inductor 140 may have another inductor structure. For example, the inductor 140 may include an inductor structure as described with reference to one or more of FIGS. 2-5.

The inductor 140 having the inductor structure 142 may include one or more sets of traces having different lengths and/or widths, which may improve an inductance and/or a quality factor (Q) of an inductor as compared to a conventional inductor. For example, the inductor 140, or a portion thereof, may have a tapered configuration, which may reduce a capacitance (e.g., a parasitic capacitance) of the inductor 140 as compared to a conventional inductor. Additionally and/or alternatively, the inductor 140 having the tapered configuration may have an improved quality factor (Q) and/or occupy a reduced area as compared to the conventional inductor. Additional illustrative examples of the inductor structure 142 are provided with reference to FIGS. 2-6. Each of the inductor structures 142 or the inductor structures of FIGS. 2-6 may be selected to be incorporated into a semiconductor device based on one or more design and/or manufacturing constraints.

Figure 2:
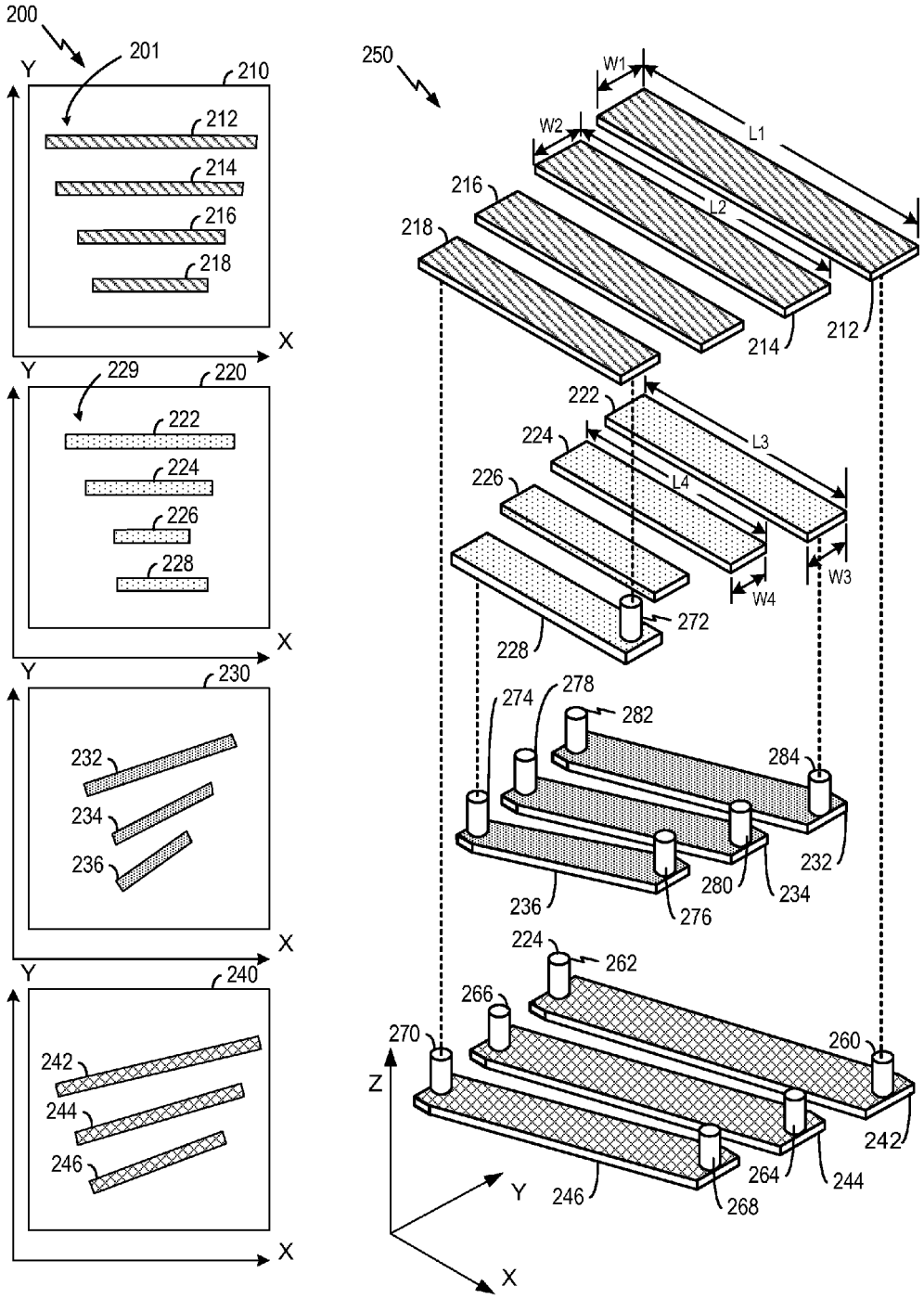
FIG. 2 illustrates a first example of an inductor structure.

Referring to FIG. 2, an illustrative aspect of an inductor structure 200 is depicted. The inductor structure 200 may include multiple sets of traces. The inductor structure 200 may include the inductor structure 142 of FIG. 1. Each set of traces may be associated with a different layer of an inductor, such as the inductor 140 of FIG. 1. For example, the inductor (e.g., the inductor structure 200) may include a first layer 210, a second layer 220, a third layer 230, and a fourth layer 240. Although the inductor structure 200 is illustrated as having four layers, in other implementations, the inductor structure 200 may include more than four layers or fewer than four layers.

The first layer 210 may include a first set of traces 212-218. Each trace of the first set of traces 212-218 may be parallel to other traces of the first set of traces 212-218. A portion 201 of the trace 212 may be associated with a first terminal of the inductor structure 200. In some implementations, the first set of traces 212-218 may have a tapered configuration.

The second layer 220 may include a second set of traces 222-228. Each trace of the second set of traces 222-228 may be parallel to other traces of second set of traces 222-228 and/or to traces of the first set of traces 212-218. A portion 229 of the trace 222 may be associated with a second terminal of the inductor structure 200. In some implementations, the second set of traces 212-228 may have a tapered configuration. The first set of traces 212-218 may at least partially overlap (in a vertical direction) the second set of traces 222-228. For example, the trace 218 may overlap the trace 228, the trace 216 may overlap the trace 226, the trace 214 may overlap the trace 224, and the trace 212 may overlap the trace 222.

The third layer 230 may include a third set of traces 232-236. At least one trace of the third set of traces 232-236 may be non-parallel to each trace of the first set of traces 212-218 and/or to each trace of the second set of traces 222-228. The fourth layer 240 may include a fourth set of traces 242-246. At least one trace of the fourth set of traces 242-246 may be non-parallel to each trace of the first set of traces 212-218 and/or to each trace of the second set of traces 222-228.

An isometric representation of the inductor structure 200 is depicted at 250. The first set of traces 212-218 are coupled to the fourth set of traces 242-246 by a set of connectors 260-270. To illustrate, the trace 212 may be coupled to the trace 242 by the connector 260, the trace 242 may be coupled to the trace 214 by the connector 262, the trace 214 may be coupled to the trace 244 by the connector 264, the trace 244 may be coupled to the trace 216 by the connector 266, the trace 216 may be coupled to the trace 246 by the trace connector 268, and the trace 246 may be coupled to the trace 218 by the connector 270. The first set of traces 212-218 may be coupled to the second set of traces 222-228 by a set of connectors (e.g., a connector 272). To illustrate, the trace 218 may be coupled to the trace 228 by the connector 272. In some implementations, the set of connectors may include a single connector (e.g., the connector 272) that couples the trace 218 to the trace 228. The third set of traces 232-236 may be coupled to the second set of traces 222-228 by a set of connectors 274-284. To illustrate, the trace 228 may be coupled to the trace 236 by the connector 274, the trace 236 may be coupled to the trace 226 by the connector 276, the trace 226 may be coupled to the trace 234 by the connector 278, the trace 234 may be coupled to the trace 224 by the connector 280, the trace 224 may be coupled to the trace 232 by the connector 282, and the trace 232 may be coupled to the trace 222 by the connector 284. The connectors 260-284 may include one or more via structures, one or more bump structures, or a combination thereof, as illustrative, non-limiting examples.

The trace 212 may have a first length (L1) and a first width (W1), and the trace 214 may have a second length (L2) and a second width (W2). In some implementations, the first length (L1) may be different from the second length (L2), the first width (W1) may be different from the second width (W2), or a combination thereof. For example, the first length (L1) may be greater than the second length (L2), and the first width (W1) may be greater than the second width (W2).

The trace 222 may have a third length (L3) and a third width (W3), and the trace 224 may have a fourth length (L4) and fourth width (W4). In some implementations, the third length (L3) may be different from the fourth length (L4), the third width (W3) may be different from the fourth width (W4), or a combination thereof. For example, the third length (L3) may be greater than the fourth length (L4), and the third width (W3) may be greater than the fourth width (W4).

By including one or more sets of traces with different dimensions (e.g., different lengths and/or different widths), the inductor structure 200 may have an improved inductance and/or an improved quality factor (Q) as compared to a conventional inductor. For example, the inductor structure 200, or a portion thereof, may have a tapered configuration which may reduce a capacitance, reduce an area occupied by the inductor structure 200, and/or improve a quality factor (Q) of the inductor structure 200 as compared to a conventional inductor.

Figure 3:
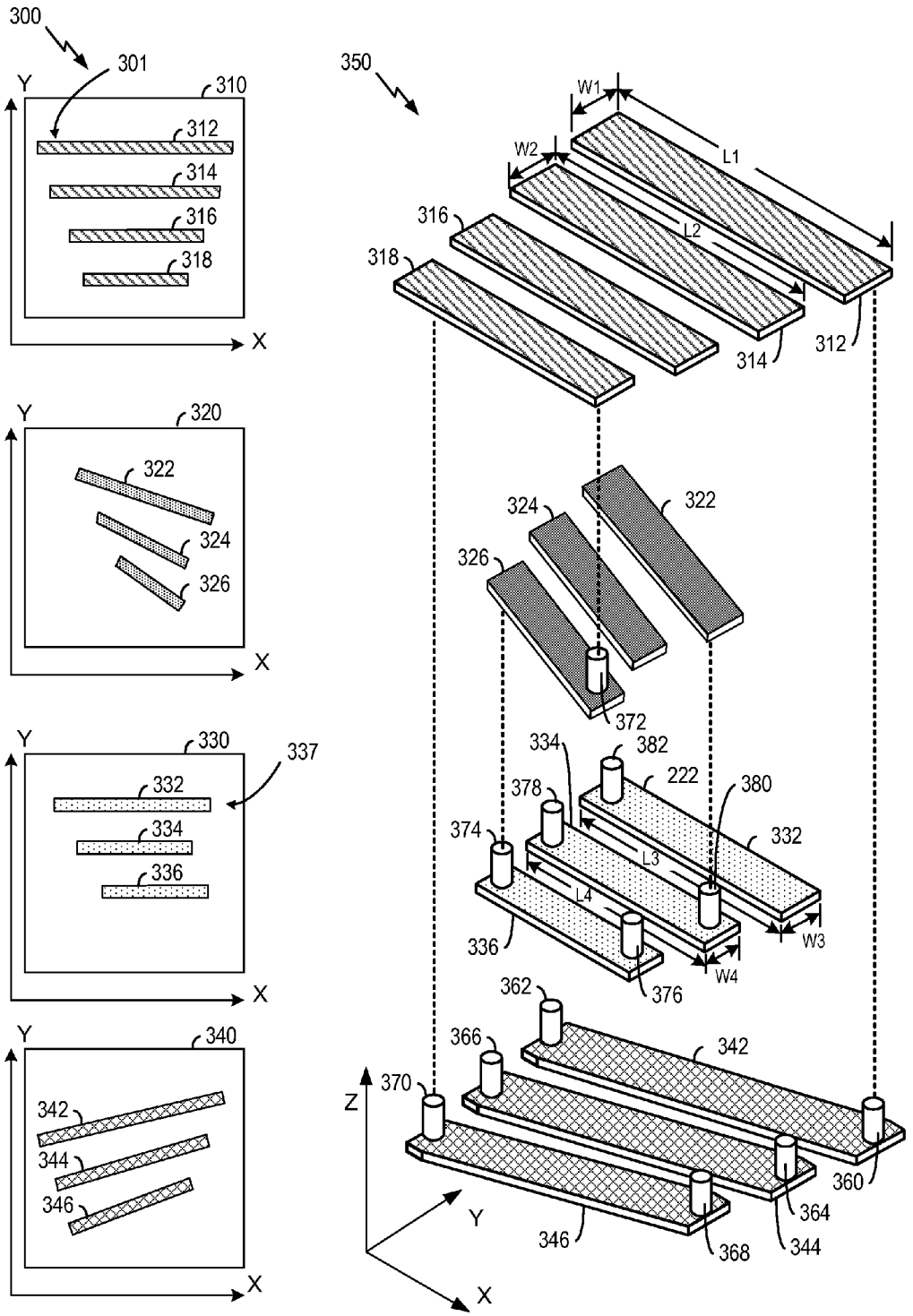
FIG. 3 illustrates a second example of an inductor structure.

Referring to FIG. 3, an illustrative aspect of an inductor structure 300 is depicted. The inductor structure 300 may include multiple sets of traces. The inductor structure 300 may include the inductor structure 142 of FIG. 1. Each set of traces may be associated with a different layer of an inductor, such as the inductor 140 of FIG. 1. For example, the inductor (e.g., the inductor structure 300) may include a first layer 310, a second layer 320, a third layer 330, and a fourth layer 340. Although the inductor structure 300 is illustrated as having four layers, in other implementations, the inductor structure 300 may include more than four layers or fewer than four layers.

The first layer 310 may include a first set of traces 312-318. Each trace of the first set of traces 312-318 may be parallel to other traces of the first set of traces 312-318. A portion 301 of the trace 312 may be associated with a first terminal of the inductor structure 300. In some implementations, the first set of traces 312-318 may have a tapered configuration.

The second layer 320 may include a second set of traces 322-326. At least one trace of the second set of traces 322-326 may be non-parallel to each trace of the first set of traces 312-318.

The third layer 330 may include a third set of traces 332-336. Each trace of the third set of traces 332-336 may be parallel to other traces of the third set of traces 332-336 and/or to traces of the first set of traces 312-318. A portion 337 of the trace 332 may be associated with a second terminal of the inductor structure 300. In some implementations, the third set of traces 332-336 may have a tapered configuration. The first set of traces 312-318 may overlap (in a vertical direction) the third set of traces 332-336. For example, the trace 316 may at least partially overlap the trace 336, the trace 314 may overlap the trace 334, and the trace 312 may overlap the trace 332.

The fourth layer 340 may include a fourth set of traces 342-346. At least one trace of the fourth set of traces 342-346 may be non-parallel to each trace of the first set of traces 312-318 and/or to each trace of the third set of traces 322-326.

An isometric representation of the inductor structure 300 is depicted at 350. The first set of traces 312-318 are coupled to the fourth set of traces 342-346 by a set of connectors 360-370. To illustrate, the trace 312 may be coupled to the trace 342 by the connector 360, the trace 342 may be coupled to the trace 314 by the connector 362, the trace 314 may be coupled to the trace 344 by the connector 354, the trace 344 may be coupled to the trace 316 by the connector 366, the trace 316 may be coupled to the trace 346 by the connector 368, and the trace 346 may be coupled to the trace 318 by the connector 370. The first set of traces 312-318 may be coupled to the second set of traces 322-326 by a set of connectors (e.g., a connector 372). To illustrate, the trace 318 may be coupled to the trace 326 by the connector (e.g., the connector 372). In some implementations, the set of connectors may include a single connector (e.g., the connector 372) that couples the trace 318 to the trace 326. The third set of traces 332-336 may be coupled to the second set of traces 322-323 by a set of connectors 374-382. To illustrate, the trace 326 may be coupled to the trace 336 by the connector 374, the trace 336 may be coupled to the trace 324 by the connector 376, the trace 324 may be coupled to the trace 334 by the connector 378, the trace 334 may be coupled to the trace 322 by the connector 380, and the trace 322 may be coupled to the trace 332 by the connector 382. The set of connectors 360-382 may include one or more via structures, one or more bump structures, or a combination thereof, as illustrative, non-limiting examples.

The trace 312 may have a first length (L1) and a first width (W1). The trace 314 may have a second length (L2) and a second width (W2). In some implementations, the first length (L1) may be different from the second length (L2), the first width (W1) may be different from the second width (W2), or a combination thereof. For example, the first length (L1) may be greater than the second length (L2), and the first width (W1) may be greater than the second width (W2).

The trace 332 may have a third length (L3) and a third width (W3). The trace 334 may have a fourth length (L4) and fourth width (W4). In some implementations, the third length (L3) may be different from the fourth length (L4), the third width (W3) may be different from the fourth width (W4), or a combination thereof. For example, the third length (L3) may be greater than the fourth length (L4), and the third width (W3) may be greater than the fourth width (W4).

Figure 4:
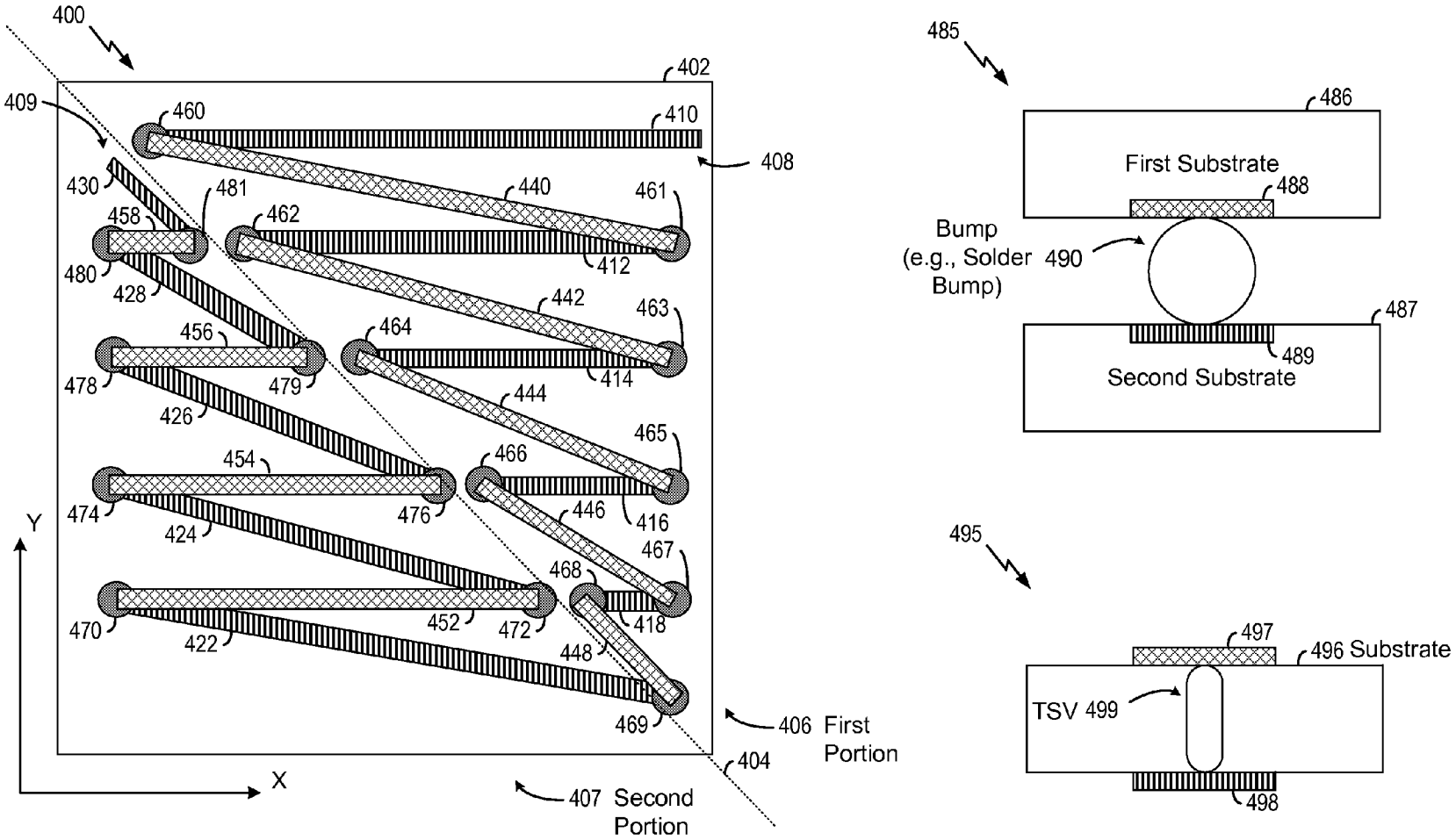
FIG. 4 illustrates a third example of an inductor structure.

Referring to FIG. 4, an illustrative aspect of an inductor structure 400 is depicted. The inductor structure 400 may include a first portion 406 (to the right of dashed line 404) having a first tapered configuration and a second portion 407 (to the left of the dashed line 404) having a second tapered configuration. The inductor structure 400 may be formed using a wafer level package (WLP) process, a package on package (PoP) process, a land grid array (LGA) package process, a silicon process, a microelectromechanical systems (MEMS) process, and/or nano-technology, as illustrative, non-limiting examples. In some implementations, the inductor structure 400 may be included in a single package. For example, the inductor structure 400 may be formed using a single substrate. In other implementations, the inductor may be included in multiple packages.

The inductor structure 400 may include multiple sets of traces. Each set of traces may be associated with a different layer of an inductor, such as the inductor 140 of FIG. 1. For example, the inductor (e.g., the inductor structure 400) may include a first set of traces 410-430 associated with a first layer of a substrate 402 and a second set of traces 440-458 associated with a second layer of a substrate (e.g., the substrate 402 or another substrate). Although the inductor structure 400 is described as having two sets of traces (e.g., two layers), in other implementations, the inductor structure 400 may include more than two sets of traces (e.g., more than two layers).

The first set of traces 410-430 may include a first sub-set of traces 410-418 that are parallel to each other and a second sub-set of traces 422-430 that are non-parallel with traces of the first sub-set of traces 410-418. A first portion 408 of the trace 410 may be associated with a first terminal of the inductor structure 400 and a second portion 409 of the trace 430 may be associated with a second terminal of the inductor structure 400.

The second set of traces 440-458 may include a third sub-set of traces 452-458 and a fourth sub-set of traces 440-448. The third sub-set of traces 452-458 may be parallel to each other and/or with the first sub-set of traces, and the fourth sub-set of traces 440-448 that are a non-parallel with the first sub-set of traces 410-418 and/or with the third sub-set of traces 452-458.

The first set of traces 410-430 may be coupled to the second set of traces 440-458 by a set of connectors 460-481. The set of connectors 460-481 may include a first set of connectors 460-468, a second set of connectors 469, and a third set of connectors 470-481. The first set of connectors 460-468 may be configured to couple the first sub-set of traces 410-418 to the fourth sub-set of traces 440-448. To illustrate, the trace 410 may be coupled to the trace 440 by the connector 460, the trace 440 may be coupled to the trace 412 by the connector 461, the trace 412 may be coupled to the trace 442 by the connector 462, the trace 442 may be coupled to the trace 414 by the connector 463, the trace 414 may be coupled to the trace 444 by the connector 464, the trace 444 may be coupled to the trace 416 by the connector 465, the trace 416 may be coupled to the trace 446 by the connector 466, the trace 446 may be coupled to the trace 418 by the connector 467, and the trace 418 may be coupled to the trace 448 by the connector 468.

The second set of connectors 469 may be configured to couple the second sub-set of traces 422-430 to the fourth sub-set of traces 440-448. For example, the second sub-set of connectors 469 may include a single connector that couples the trace 448 to the trace 422. To illustrate, the trace 448 may be coupled to the trace 422 by the connector 469. The third set of connectors 470-481 may be configured to couple the second sub-set of traces 422-430 to the third sub-set of traces 452-458. To illustrate the trace 422 may be coupled to the trace 452 by the connector 470, the trace 452 may be coupled to the trace 424 by the connector 472, the trace 424 may be coupled to the trace 454 by the connector 474, the trace 454 may be coupled to the trace 426 by the connector 476, the trace 426 may be coupled to the trace 456 by the connector 478, the trace 456 may be coupled to the trace 428 by the connector 479, the trace 428 may be coupled to the trace 458 by the connector 480, and the trace 458 may be coupled to the trace 430 by the connector 481.

The connectors 260-284 may include one or more via structures, one or more bump structures, or a combination thereof, as illustrative, non-limiting examples. To illustrate, an example of a bump structure is depicted at 485, where a first trace 488 of an inductor, such as the inductor 140 of FIG. 1, is associated with a first substrate 486 (e.g., a first chip or a first package) and a second trace 489 of the inductor is associated with a second substrate 487 (e.g., a second chip or a second package). The first trace 488 is coupled to the second trace 489 by a bump 490, such as a solder bump. In a particular illustrative example, the first trace 488 may include the trace 440, the second trace 489 may include the trace 410, and the bump 490 may include the connector 460.

An example of a via structure is depicted at 495, where a first trace 497 and a second trace 498 of an inductor, such as the inductor 140 of FIG. 1, are associated with a substrate 496 (e.g., a chip or a package). For example, the substrate 496 may include the substrate 402. In some implementations, the substrate may include a silicon substrate. In other implementations, the substrate may include glass substrate. The first trace 497 may be coupled to the second trace 498 by a via structure 499, such as a through-silicon via (TSV) or a through-glass via. In a particular illustrative example, the first trace 497 may include the trace 440, the second trace 498 may include the trace 410, and the via structure 499 may include the connector 460.

By including a sub-set of parallel traces associated with each layer of the inductor structure 400, the inductor structure 400 may have a compact design and/or may have a reduced area as compared to a conventional inductor. Additionally, the inductor structure 400 an improved inductance and/or an improved quality factor (Q) as compared to the conventional inductor.

Figure 5:
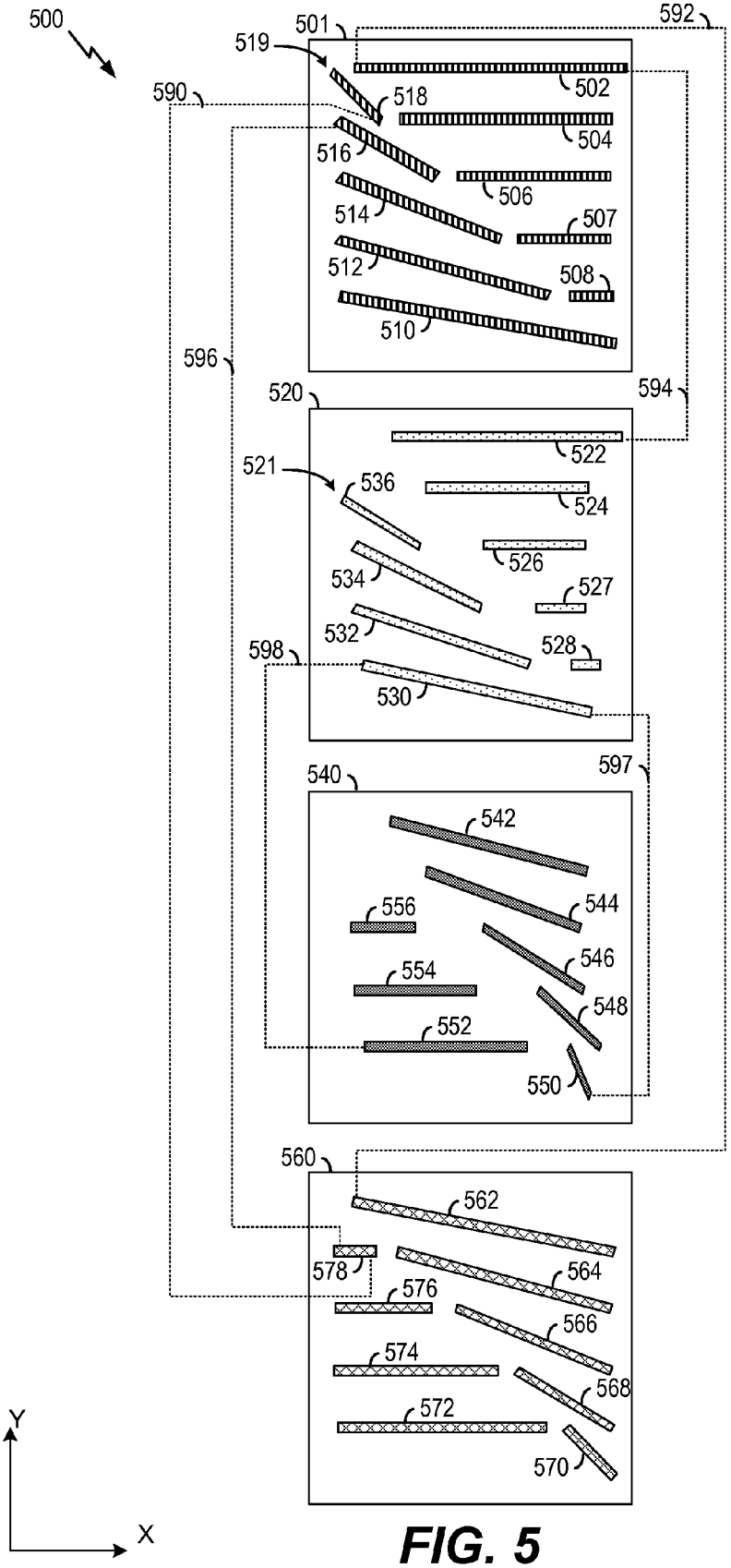
FIG. 5 illustrates a fourth example of an inductor structure.

Referring to FIG. 5, an illustrative aspect of an inductor structure 500 is depicted. The inductor structure 500 may include multiple sets of traces. The inductor structure 500 may include the inductor structure 142 of FIG. 1. Each set of traces may be associated with a different layer of an inductor, such as the inductor 140 of FIG. 1. For example, the inductor (e.g., the inductor structure 500) may include a first layer 501, a second layer 520, a third layer 540, and a fourth layer 560. Although the inductor structure 500 is illustrated as having four layers, in other implementations, the inductor structure 500 may include more than four layers or fewer than four layers.

The first layer 501 may include a first set of traces 502-518. The first set of traces 502-518 may include the first set of traces of FIG. 1 (e.g., the first trace 150, the second trace 152, and/or the additional trace 194). The first set of traces 502-518 may include a first sub-set of traces 502-508 that are parallel to each other and a second sub-set of traces 510-518 that are non-parallel to the first sub-set of traces 502-508. A first portion 519 of the trace 518 may be associated with a first terminal of the inductor structure 500.

The second layer 520 may include a second set of traces 522-536. The second set of traces 522-536 may include the third set of traces of FIG. 1 (e.g., the fourth trace 170). The second set of traces 522-536 may include a third sub-set of traces 522-528 and a fourth sub-set of traces 530-536. The third sub-set of traces 522-528 may be parallel with each other and/or with the first sub-set of traces 502-508. The fourth sub-set of traces 530-536 may be non-parallel with the third sub-set of traces 530-536. A second portion 521 of the trace 536 may be associated with a second terminal of the inductor structure 500.

The third layer 540 may include a third set of traces 542-556. The third set of traces 542-556 may include a fifth sub-set of traces 552-556 and a sixth sub-set of traces 542-550. The fifth sub-set of traces 552-556 may be parallel with each other, with the third sub-set of traces 522-528, and/or with the first sub-set of traces 502-508. The sixth sub-set of traces 542-550 may be non-parallel with the fifth sub-set of traces 552-556.

The fourth layer 560 may include a fourth set of traces 562-578. The fourth set of traces 562-578 may include the second set of traces of FIG. 1 (e.g., the third trace 160). The fourth set of traces 562-578 may include a seventh sub-set of traces 572-578 and an eighth sub-set of traces 562-570. The seventh sub-set of traces 572-578 may be parallel with each other, with the fifth sub-set of traces 552-556, with the third sub-set of traces 522-528, and/or with the first sub-set of traces 502-508. Each trace of the eighth sub-set of traces 562-570 may be non-parallel to the seventh sub-set of traces 572-578.

The inductor structure 500 may include connectors (not shown and omitted for clarity). For example, the connectors may include one or more via structures, one or more bumps, or a combination thereof. Each of dashed lines 590-598 is representative of a connector that may be included in the inductor structure 500. The connectors may be configured to couple traces of different layers. For example, the connectors may include a first set of connectors configured to couple the first set of traces 502-518 to the fourth set of traces 562-578, a second set of connectors configured to couple the first set of traces 502-518 to the second set of traces 522-536, and a third set of connectors configured to couple the second set of traces 522-536 to the third set of traces 542-556.

The first set of connectors may include a first sub-set of connectors, a second sub-set of connectors, and a third sub-set of connectors. The first sub-set of connectors may be configured to couple the first sub-set of traces 502-508 to the eighth sub-set of traces 562-570. To illustrate, the trace 502 may be coupled to the trace 562 by a first connector (represented by the dashed line 592) of the first sub-set of connectors, the trace 562 may be coupled to the trace 504 by a second connector of the first sub-set of connectors, the trace 504 may be coupled to the trace 564 by a third connector of the first sub-set of connectors, the trace 564 may be coupled to the trace 506 by a fourth connector of the first sub-set of connectors, the trace 506 may be coupled to the trace 566 by a fifth connector of the first sub-set of connectors, the trace 566 may be coupled to the trace 507 by a sixth connector of the first sub-set of connectors, the trace 507 may be coupled to the trace 568 by a seventh connector of the first sub-set of connectors, the trace 568 may be coupled to the trace 508 by an eighth connector of the first sub-set of connectors, and the trace 508 may be coupled to the trace 570 by a ninth connector of the first sub-set of connectors.

The second sub-set of connectors may be configured to couple the second sub-set of traces 510-518 to the seventh sub-set of traces 572-578. To illustrate, the trace 510 may be coupled to the trace 572 by a first connector of the second sub-set of connectors, the trace 572 may be coupled to the trace 512 by a second connector of the second sub-set of connectors, the trace 512 may be coupled to the trace 574 by a third connector of the second sub-set of connectors, the trace 574 may be coupled to the trace 514 by a fourth connector of the second sub-set of connectors, the trace 514 may be coupled to the trace 576 by a fifth connector of the second sub-set of connectors, the trace 576 may be coupled to the trace 516 by a sixth connector of the second sub-set of connectors, the trace 516 may be coupled to the trace 578 by a seventh connector (represented by the dashed line 596) of the second sub-set of connectors, and the trace 578 may be coupled to the trace 518 by an eighth connector (represented by the dashed line 690) of the second sub-set of connectors.

The third sub-set of connectors may be configured to couple the eighth sub-set of traces 562-570 to the second sub-set of traces 510-518. For example, the third sub-set of connectors may include a single connector that couples the eighth sub-set of traces 562-570 to the second sub-set of traces 510-518. To illustrate, the third sub-set of connectors may include a connector configured to couple the trace 510 to the trace 570.

The second set of connectors may be configured to couple the first sub-set of traces 502-508 to the third sub-set of traces 522-528. In some implementations, the second set of connectors may include a single connector configured to couple the trace 502 to the trace 522. To illustrate, the trace 502 may be coupled to the trace 522 by a connector (represented by the dashed line 594) of the second set of connectors.

The third sub-set of connectors may include a fourth sub-set of connectors, a fifth sub-set of connectors, and a sixth sub-set of connectors. The fourth sub-set of connectors may be configured to couple the third sub-set of traces 522-528 to the sixth sub-set of traces 542-550. To illustrate, the trace 522 may be coupled to the trace 542 by a first connector of the fourth sub-set of connectors, the trace 542 may be coupled to the trace 524 by a second connector of the fourth sub-set of connectors, the trace 524 may be coupled to the trace 544 by a third connector of the fourth sub-set of connectors, the trace 544 may be coupled to the trace 526 by a fourth connector of the fourth sub-set of connectors, the trace 526 may be coupled to the trace 546 by a fifth connector of the fourth sub-set of connectors, the trace 546 may be coupled to the trace 527 by a sixth connector of the fourth sub-set of connectors, the trace 527 may be coupled to the trace 548 by a seventh connector of the fourth sub-set of connectors, the trace 548 may be coupled to the trace 528 by an eighth connector of the fourth sub-set of connectors, and the trace 528 may be coupled to the trace 550 by a ninth connector of the fourth sub-set of connectors.

The fifth sub-set of connectors may be configured to couple the fourth sub-set of traces 530-536 to the fifth sub-set of traces 552-556. To illustrate, the trace 530 may be coupled to the trace 552 by a first connect (represented by the dashed line 598) of the fifth sub-set of connectors, the trace 552 may be coupled to the trace 532 by a second connector of the fifth sub-set of connectors, the trace 532 may be coupled to the trace 554 by a third connector of the fifth sub-set of connectors, the trace 554 may be coupled to the trace 534 by a fourth connector of the fifth sub-set of connectors, the trace 534 may be coupled to the trace 556 by a fifth connector of the fifth sub-set of connectors, the trace 556 may be coupled to the trace 536 by a sixth connector of the fifth sub-set of connectors.

The sixth sub-set of connectors may be configured to couple the sixth sub-set of trace 542-550 to the fourth sub-set of traces 530-536. For example, the sixth sub-set of connectors may include a single connector that couples the sixth sub-set of trace 542-550 to the fourth sub-set of traces 530-536. To illustrate, the sixth sub-set of connectors may include a connector (represented by the dashed line 597) configured to couple the trace 530 to the trace 550.

Figure 6:
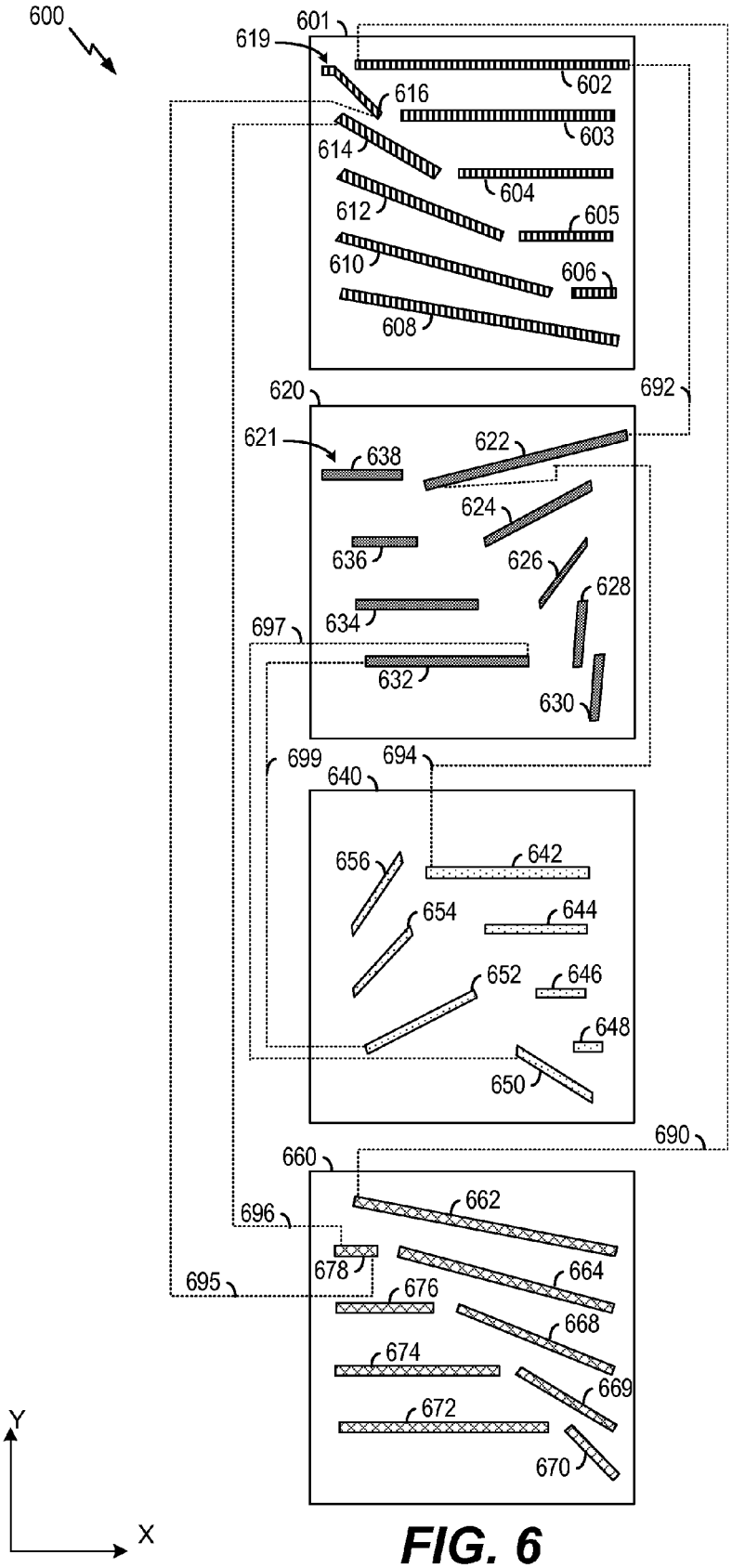
FIG. 6 illustrates a fifth example of an inductor structure.

Referring to FIG. 6, an illustrative aspect of an inductor structure 600 is depicted. The inductor structure 600 may include multiple sets of traces. The inductor structure 600 may include the inductor structure 142 of FIG. 1. Each set of traces may be associated with a different layer of an inductor, such as the inductor 140 of FIG. 1. For example, the inductor (e.g., the inductor structure 600) may include a first layer 601, a second layer 620, a third layer 640, and a fourth layer 660. Although the inductor structure 600 is illustrated as having four layers, in other implementations, the inductor structure 600 may include more than four layers or fewer than four layers.

The first layer 601 may include a first set of traces 602-616. The first set of traces 602-616 may include the first set of traces of FIG. 1 (e.g., the first trace 150, the second trace 152, and/or the additional trace 194). The first set of traces 602-616 may include a first sub-set of traces 602-606 that are parallel to each other and a second sub-set of traces 608-616 that are non-parallel to the first set of traces 602-616. A first portion 619 of the trace 616 may be associated with a first terminal of the inductor structure 600.

The second layer 620 may include a second set of traces 622-638. The second set of traces 622-638 may include the third set of traces of FIG. 1 (e.g., the fourth trace 170). The second set of traces 622-638 may include a third sub-set of traces 632-638 and a fourth sub-set of traces 622-630. The third sub-set of traces 632-638 may be parallel with each other and/or with the first sub-set of traces 602-606. The fourth sub-set of traces 622-630 may be non-parallel with the third sub-set of traces 632-638. A second portion 621 of the trace 638 may be associated with a second terminal of the inductor structure 600.

The third layer 640 may include a third set of traces 642-656. The third set of traces 642-656 may include a fifth sub-set of traces 642-648 and a sixth sub-set of traces 650-656. The fifth sub-set of traces 642-648 may be parallel with each other, with the third sub-set of traces 632-638, and/or with the first sub-set of traces 602-606. The sixth sub-set of traces 650-656 may be non-parallel with the fifth sub-set of traces 642-648.

The fourth layer 660 may include a fourth set of traces 662-678. The third set of traces 662-678 may include the second set of traces of FIG. 1 (e.g., the third trace 160). The fourth set of traces 662-678 may include a seventh sub-set of traces 672-678 and an eighth sub-set of traces 662-670. The seventh sub-set of traces 672-678 may be parallel with each other, with the fifth sub-set of traces 642-648, with the third sub-set of traces 632-638, and/or with the first sub-set of traces 602-606. The eighth sub-set of traces 662-670 may be non-parallel with the seventh sub-set of traces 672-678.

The inductor structure 600 may include connectors (not shown and omitted for clarity). For example, the connectors may include one or more via structures, one or more bumps, or a combination thereof. Each of dashed lines 690-699 is representative of a connector that may be included in the inductor structure 600. The connectors may be configured to couple traces of different layers. For example, the connectors may include a first set of connectors configured to couple the first set of traces 602-616 to the fourth set of traces 662-678, a second set of connectors configured to couple the first set of traces 602-616 to the second set of traces 622-638, and a third set of connectors configured to couple the second set of traces 622-638 to the third set of traces 642-656.

The first set of connectors may include a first sub-set of connectors, a second sub-set of connectors, and a third sub-set of connectors. The first sub-set of connectors may be configured to couple the first sub-set of traces 602-606 to the eighth sub-set of traces 662-670. To illustrate, the trace 602 may be coupled to the trace 662 by a first connector (represented by the dashed line 690) of the first sub-set of connectors, the trace 662 may be coupled to the trace 603 by a second connector of the first sub-set of connectors, the trace 603 may be coupled to the trace 664 by a third connector of the first sub-set of connectors, the trace 664 may be coupled to the trace 604 by a fourth connector of the first sub-set of connectors, the trace 604 may be coupled to the trace 668 by a fifth connector of the first sub-set of connectors, the trace 668 may be coupled to the trace 605 by a sixth connector of the first sub-set of connectors, the trace 605 may be coupled to the trace 669 by a seventh connector of the first sub-set of connectors, the trace 669 may be coupled to the trace 606 by an eighth connector of the first sub-set of connectors, and the trace 606 may be coupled to the trace 670 by a ninth connector of the first sub-set of connectors.

The second sub-set of connectors may be configured to couple the second sub-set of traces 608-616 to the seventh sub-set of traces 672-678. To illustrate, the trace 608 may be coupled to the trace 672 by a first connector of the second sub-set of connectors, the trace 672 may be coupled to the trace 610 by a second connector of the second sub-set of connectors, the trace 610 may be coupled to the trace 674 by a third connector of the second sub-set of connectors, the trace 674 may be coupled to the trace 612 by a fourth connector of the second sub-set of connectors, the trace 612 may be coupled to the trace 676 by a fifth connector of the second sub-set of connectors, the trace 676 may be coupled to the trace 614 by a sixth connector of the second sub-set of connectors, the trace 614 may be coupled to the trace 678 by a seventh connector (represented by the dashed line 696) of the second sub-set of connectors, and the trace 678 may be coupled to the trace 616 by an eighth connector (represented by the dashed line 695) of the second sub-set of connectors.

The third sub-set of connectors may be configured to couple the second sub-set of traces 608-616 to the eighth sub-set of traces 662-670. For example, the third sub-set of connectors may include a single connector that couples the second sub-set of traces 608-616 to the eighth sub-set of traces 662-670. To illustrate, the third sub-set of connectors may include a connector configured to couple the trace 608 to the trace 670.

The second set of connectors may be configured to couple the first sub-set of traces 602-606 to the fourth sub-set of traces 622-630. In some implementations, the second set of connectors may include a single connector configured to couple the trace 602 to the trace 622. To illustrate, the trace 602 may be coupled to the trace 622 by a connector (represented by the dashed line 692) of the second set of connectors.

The third sub-set of connectors may include a fourth sub-set of connectors, a fifth sub-set of connectors, and a sixth sub-set of connectors. The fourth sub-set of connectors may be configured to couple the third sub-set of traces 632-638 to the sixth sub-set of traces 650-656. To illustrate, the trace 650 may be coupled to the trace 632 by a first connector (represented by the dashed line 697) of the fourth sub-set of connectors, the trace 632 may be coupled to the trace 652 by a second connector (represented by the dashed line 699) of the fourth sub-set of connectors, the trace 652 may be coupled to the trace 634 by a third connector of the fourth sub-set of connectors, the trace 634 may be coupled to the trace 654 by a fourth connector of the fourth sub-set of connectors, the trace 654 may be coupled to the trace 636 by a fifth connector of the fourth sub-set of connectors, the trace 636 may be coupled to the trace 656 by a sixth connector of the fourth sub-set of connectors, and the trace 656 may be coupled to the trace 638 by a seventh connector of the fourth sub-set of connectors.

The fifth sub-set of connectors may be configured to couple the fourth sub-set of traces 622-630 to the fifth sub-set of traces 642-648. To illustrate, the trace 622 may be coupled to the trace 642 by a first connector (represented by the dashed line 694) of the fourth sub-set of connectors, the trace 642 may be coupled to the trace 624 by a second connector of the fourth sub-set of connectors, the trace 624 may be coupled to the trace 644 by a third connector of the fourth sub-set of connectors, the trace 644 may be coupled to the trace 626 by a fourth connector of the fourth sub-set of connectors, the trace 626 may be coupled to the trace 646 by a fifth connector of the fourth sub-set of connectors, the trace 646 may be coupled to the trace 628 by a sixth connector of the fourth sub-set of connectors, the trace 628 may be coupled to the trace 648 by a seventh connector of the fourth sub-set of connectors, and the trace 648 may be coupled to the trace 630 by an eighth connector of the fourth sub-set of connectors.

The sixth sub-set of connectors may be configured to couple the sixth sub-set of traces 650-656 to the fourth sub-set of traces 622-630. For example, the sixth sub-set of connectors may include a single connector that couples the sixth sub-set of traces 650-656 to the fourth sub-set of traces 622-630. To illustrate, the sixth sub-set of connectors may include a connector configured to couple the trace 630 to the trace 650.

Figure 7:
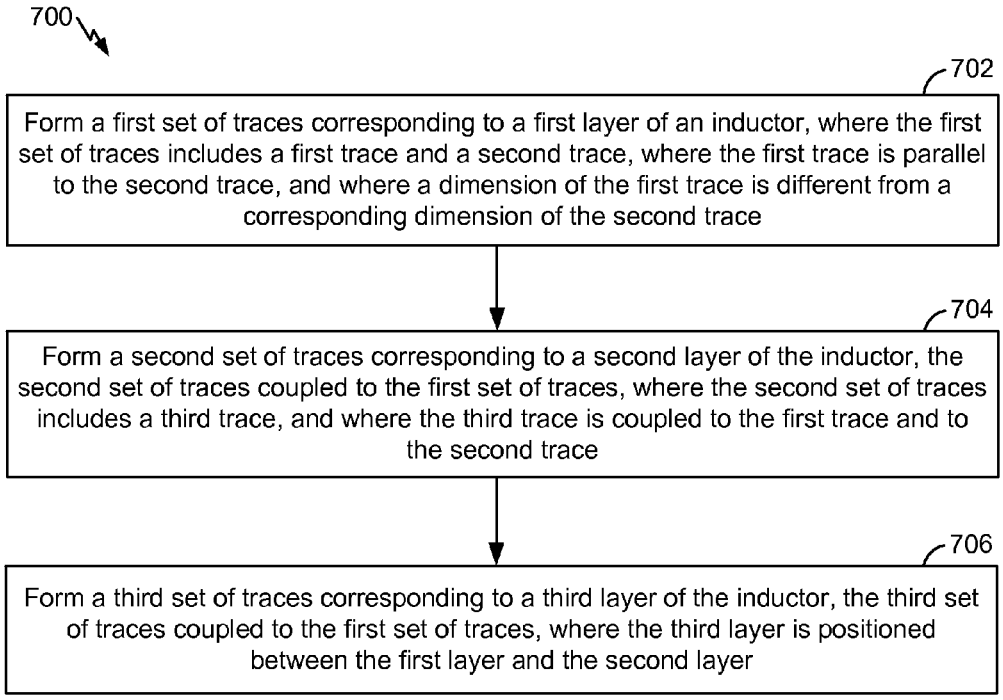
FIG. 7 is a flow chart of a particular illustrative aspect of a method of forming an inductor structure.

Referring to FIG. 7, a flow diagram of an illustrative aspect of a method 700 of forming an inductor structure is depicted. The inductor structure may be included in an inductor, such as the inductor 140 of FIG. 1. The inductor structure may include the inductor structure 142 of FIG. 1, the inductor structure 200 of FIG. 2, the inductor structure 300 of FIG. 3, the inductor structure 400 of FIG. 4, the inductor structure 500 of FIG. 5, or the inductor structure 600 of FIG. 6.

The method 700 may include forming a first set of traces corresponding to a first layer of the inductor, where the first set of traces includes a first trace and a second trace, where the first trace is parallel to the second trace, and where a dimension of the first trace is different from a corresponding dimension of the second trace, at 702. For example, the first trace may have a different length and/or width than the second trace. The first set of traces may include multiple traces. For example, the first set of traces may include the first trace 150, the second trace 152, the additional trace 194 of FIG. 1, the traces 212-218 of FIG. 2, the traces 312-318 of FIG. 3, the traces 410-418 of FIG. 4, the traces 502-508 of FIG. 5, or the traces 602-606 of FIG. 6. Each trace of first set of traces (e.g., the multiple traces) may have a different length and/or a different width. For example, the first length may be less than the second length. As another example, a first width of the first trace may be different (e.g., less) than a second width of the second trace. In some implementations, the first set of traces may have a tapered configuration.

The method 700 may further include forming a second set of traces corresponding to a second layer of the inductor, the second set of traces coupled to the first set of traces, where the second set of traces includes a third trace, and where the third trace is coupled to the first trace and to the second trace, at 704. The second set of traces may include the third trace 160 of FIG. 1, the traces 242-246 of FIG. 2, the traces 342-346 of FIG. 3, the traces 440-448 of FIG. 4, the traces 562-570 of FIG. 5, or the traces 662-670 of FIG. 6.

The method 700 may further include forming a third set of traces corresponding to a third layer of the inductor, the third set of traces coupled to the first set of traces, where the third layer is positioned between the first layer and the second layer, at 706. The third set of traces may include the fourth trace 170 of FIG. 1, the traces 222-228, the traces 322-326 of FIG. 3, the traces 522-528 of FIG. 5, or the traces 622-630 of FIG. 6. In some implementations, the third set of traces includes a fourth trace and a fifth trace that is parallel to the fourth trace. The fourth trace and the fifth trace may have different lengths. The fourth trace may be coupled to the second trace. In a particular implementations, the first trace at least partially overlaps the fifth trace and the second trace at least partially overlaps the fourth trace. In other implementations, the first trace may overlap an entirety of the fifth trace and/or the second trace may overlap an entirety of the fourth trace In some implementations, the method 700 may include forming a first set of connectors configured to couple the first set of traces to the second set of traces. For example, the first set of connectors may include multiple connectors, such as the connectors 180, 182 of FIG. 1, the connectors 260-270 of FIG. 2, the connectors 360-370 of FIG. 3, or the connectors 460-468 of FIG. 4. Additionally or alternatively, the method 700 may include forming a second set of connectors configured to couple the first set of traces to the third set of traces. For example, the second set of connectors may include the third connector 184 of FIG. 1, the connector 272 of FIG. 2, or the connector 372 of FIG. 3. At least one connector of the second set of connectors may include a via structure (e.g., the via structure 499 of FIG. 4), a bump (e.g., the bump 490 of FIG. 4), or a combination thereof. In a particular implementation, the second set of connectors includes a single connector.

In some implementations, the method 700 may include forming a fourth set of traces corresponding to a fourth layer of the inductor. For example, the fourth set of traces may include the traces 232-236 of FIG. 2, the traces 332-336 of FIG. 3, the traces 542-550 of FIG. 5, or the traces 642-650 of FIG. 6. The fourth layer may be positioned between the first layer and the second layer. The third layer may be positioned between the first layer and the fourth layer. The fourth set of traces includes a sixth trace and a seventh trace that is parallel to the sixth trace. In a particular implementation, the third trace may be coupled to the sixth trace and to the seventh trace. The method 700 may include forming a third set of connectors that is configured to couple the third set of traces to the fourth set of traces. For example, the third set of connectors may include the connectors 274-284 of FIG. 2 or the connectors 374-382 of FIG. 3.

In some implementations, the first set of traces further includes an eighth trace that is parallel to the first trace and to the second trace. For example, the first trace, the second trace, and the eighth trace may include the first trace 150, the second trace 152, and the additional trace 194 of FIG. 1, respectively. As another example, the first trace, the second trace, and the eighth trace may include the trace 216, the trace 214, and the trace 212 of FIG. 2, respectively. The second trace may be positioned between the first trace and the eighth trace. The first trace and the second trace may be a first distance apart and the second trace and the eighth trace may be a second distance apart. The first distance may be different from the second distance. For example, the first distance may be smaller than the second distance.

In some implementations, the first set of traces may include a first sub-set of traces and a second sub-set of traces. Each trace of the first sub-set of traces may be parallel to other traces of the first sub-set of traces, and each trace of the second sub-set of traces may be non-parallel to other traces of the second sub-set of traces. For example, referring to FIG. 5, the first set of traces 502-518 may include the parallel sub-set of traces 502-508 and the non-parallel sub-set of traces 510-518. As another example, referring to FIG. 6, the first set of traces 602-616 may include the parallel sub-set of traces 602-606 and the non-parallel sub-set of traces 608-616. Additionally, the second set of traces includes a third sub-set of traces and a fourth sub-set of traces. Each trace of the third sub-set of traces is parallel to other traces of the third sub-set of traces, and each trace of the fourth sub-set of traces is non-parallel to other traces of the fourth sub-set of traces. For example, referring to FIG. 5, the fourth set of traces 562-578 may include the parallel sub-set of traces 572-578 and the non-parallel sub-set of traces 562-570. As another example, referring to FIG. 6, the fourth set of traces 642-656 may include the parallel sub-set of traces 642-648 and the non-parallel sub-set of traces 652-656.

The method 700 may be used to form an inductor, such as a planar solenoid inductor. The inductor, or a portion thereof, may have a structure (e.g., an inductor structure) that has a tapered configuration. The inductor may have a high quality factor (Q) and may have low parasitic capacitance.

Figure 8:
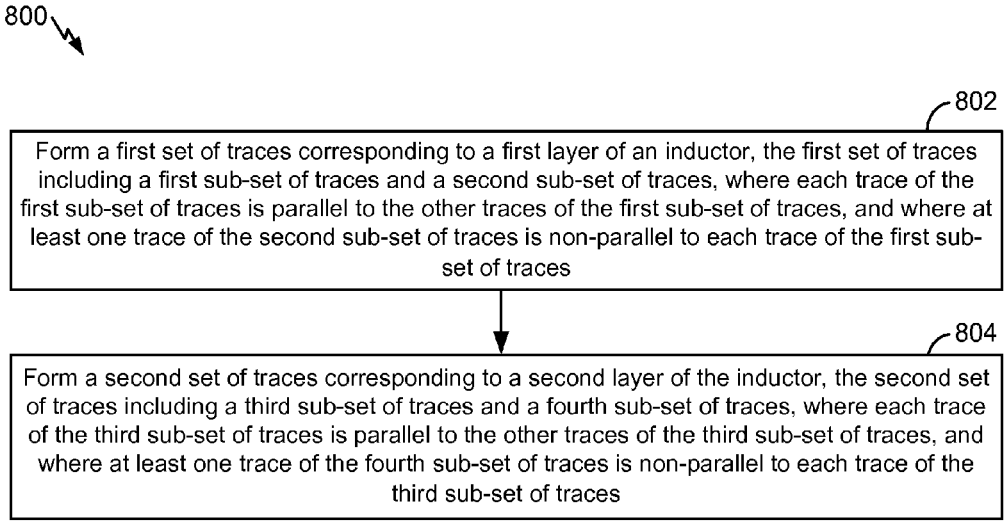
FIG. 8 is a flow chart of a particular illustrative aspect of another method of forming an inductor structure.

Referring to FIG. 8, a flow diagram of an illustrative aspect of a method 800 of forming an inductor structure is depicted. The inductor structure may be included in an inductor, such as the inductor 140 of FIG. 1. The inductor structure may include the inductor structure 400 of FIG. 4, the inductor structure 500 of FIG. 5, or the inductor structure 600 of FIG. 6.

The method 800 may include forming a first set of traces corresponding to a first layer of the inductor, the first set of traces including a first sub-set of traces and a second sub-set of traces, where each trace of the first sub-set of traces is parallel to the other traces of the first sub-set of traces, and where at least one trace of the second sub-set of traces is non-parallel to each trace of the first sub-set of traces, at 802. The first set of traces may include the first set of traces 410-430 of FIG. 3, the first set of traces 502-518 of FIG. 5, or the first set of traces 602-616 of FIG. 6. The first sub-set of traces may include the parallel sub-set of traces 410-418 of FIG. 4, the parallel sub-set of traces 502-508 of FIG. 5, or the parallel sub-set of traces 602-606 of FIG. 6.

The method 800 may further include forming a second set of traces corresponding to a second layer of the inductor, the second set of traces including a third sub-set of traces and a fourth sub-set of traces, where each trace of the third sub-set of traces is parallel to the other traces of the third sub-set of traces, and where at least one trace of the fourth sub-set of traces is non-parallel to each trace of the third sub-set of traces, at 804. The second set of traces may include the second set of traces 440-458 of FIG. 4, the fourth set of traces 562-578, or the fourth set of traces 642-656 of FIG. 6. The third sub-set of traces may include the parallel sub-set of traces 452-458 of FIG. 4, the parallel sub-set of traces 572-578 of FIG. 5, or the parallel sub-set of traces 642-648 of FIG. 6. The fourth sub-set of traces may include the non-parallel traces 440-448 of FIG. 4, the non-parallel sub-set of traces 562-570 of FIG. 5, or the non-parallel sub-set of traces 652-656 of FIG. 6.

In some implementations, the method 800 may include forming a set of connectors. For example, the set of connectors may include the set of connectors 460-481 of FIG. 4. The set of connectors may include a first sub-set of connectors and a second sub-set of connectors. The first sub-set of connectors may be configured to couple the first sub-set of traces to the fourth sub-set of traces. For example, the first sub-set of connectors may include the connectors 460-468 of FIG. 4. The second sub-set of connectors may be configured to couple the second sub-set of traces to the third sub-set of traces. For example, the second sub-set of connectors may include the connectors 470-482 of FIG. 4. At least one connector may be configured to couple the second sub-set of traces to the fourth sub-set of connectors. For example, referring to FIG. 4, the second sub-set of connectors 469 (e.g., a single connector) may be configured to couple a first particular trace, such as the trace 422, of the first set of traces to a second particular trace, such as the trace 448, of the second set of traces. A particular connector of the first set of connectors includes a via structure (e.g., the via structure 499 of FIG. 4), a bump (e.g., the bump 490 of FIG. 4), or a combination thereof. In some implementations, the first set of traces may be formed on a first surface of a first device, and the second set of traces may be formed on a second surface of a second device.

In some implementations, the method 800 may include forming a third set of traces corresponding to a third layer. The third set of traces may include the traces 522-536 of FIG. 5 or the traces 622-638 of FIG. 6. The third set of traces may include a fifth sub-set of traces and a sixth sub-set of traces. For example, the fifth sub-set of traces may include the traces 522-528 of FIG. 5 or the traces 632-638 of FIG.

6. The sixth sub-set of traces may include the traces 530-536 of FIG. 5 or the traces 622-630 of FIG. 6. Each trace of the fifth sub-set of traces may be parallel to other traces of the fifth sub-set of traces, and at least one trace of the sixth sub-set of traces is non-parallel to each trace of the fifth sub-set of traces.

Additionally or alternatively, the method 800 may include forming a fourth set of traces corresponding to a fourth layer. The fourth set of traces may include the traces 542-556 of FIG. 5, or the traces 642-656 of FIG. 6. The fourth set of traces may include a seventh sub-set of traces and an eighth sub-set of traces. For example, the seventh sub-set of traces may include the traces 552-556 of FIG. 5 or the traces 642-648 of FIG. 6. The eighth sub-set of traces may include the traces 542-550 of FIG. 5 or the traces 652-656 of FIG. 6. Each trace of the seventh sub-set of traces is parallel to other traces of the seventh sub-set of traces, and at least one trace of the eighth sub-set of traces is non-parallel to each trace of the eighth sub-set of traces.

In some implementations, a connector may be configured to couple the first set of traces to the third set of traces. For example, referring to FIG. 5, a single connector may be configured to couple a first particular trace, such as the trace 502, of the traces 502-518 to a second particular trace, such as the trace 522, of the set of traces 522-536. As another example, referring to FIG. 6, a single connector may be configured to couple a first particular trace, such as the trace 602, of the first set of traces 602-616 to a second particular trace 622 of the set of traces 622-638.

The method 800 may be used to form an inductor, such as a planar solenoid inductor. The inductor, or a portion thereof, may have a structure (e.g., an inductor structure) that has a tapered configuration. The inductor may have a high quality factor (Q) and may have low parasitic capacitance.

The method 700 of FIG. 7 and/or the method 800 of FIG. 8 may be controlled by a processing unit such as a central processing unit (CPU), a controller, a field-programmable gate array (FPGA) device, an application-specific integrated circuit (ASIC), another hardware device, firmware device, or any combination thereof. As an example, the method 700 of FIG. 7 and/or the method 800 of FIG. 8 can be performed by one or more processors that execute instructions to control fabrication equipment.

Figure 9:
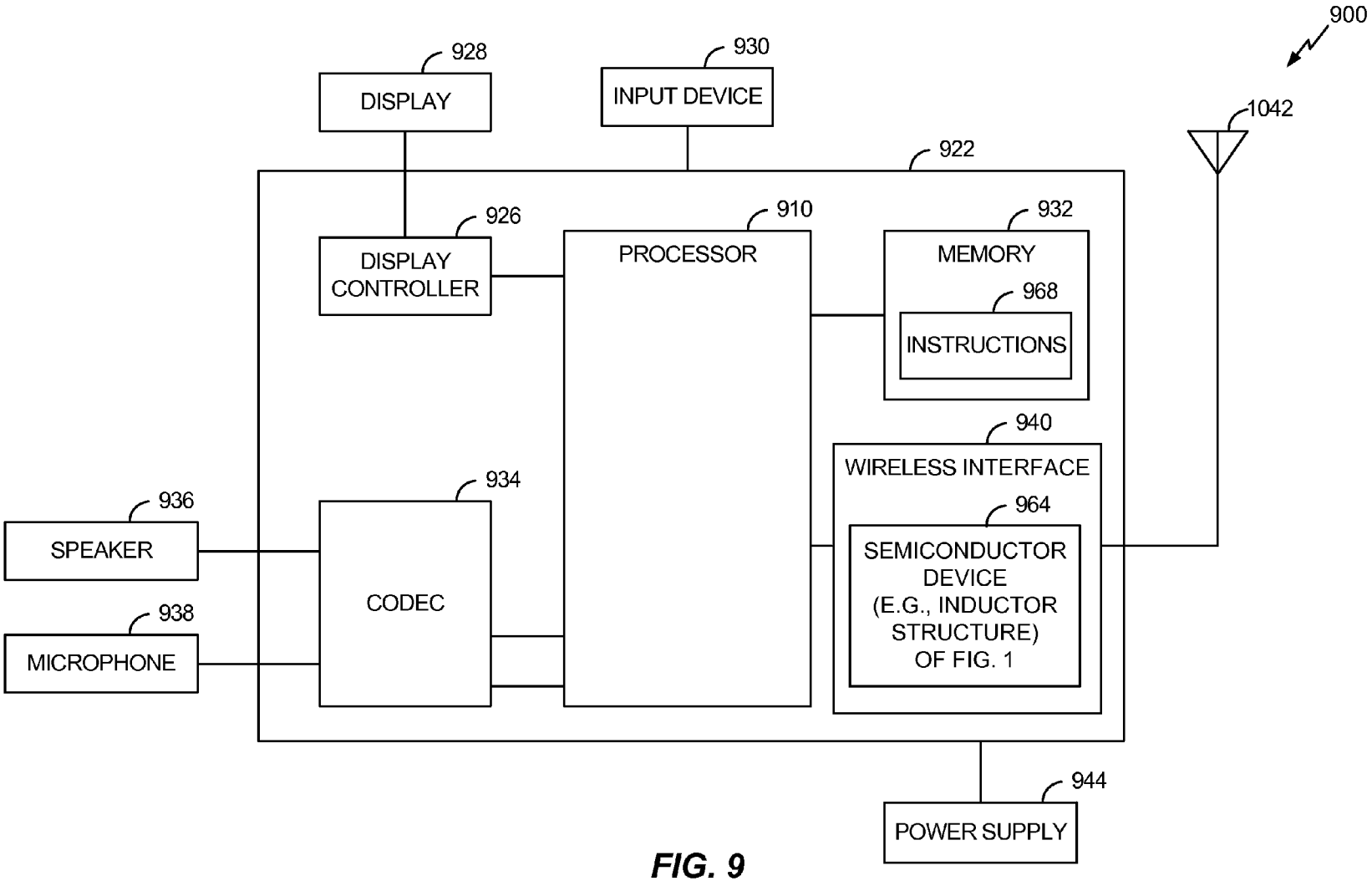
FIG. 9 is a block diagram of an electronic device including the inductor of FIG. 1.

Referring to FIG. 9, a block diagram of a particular illustrative aspect of an electronic device 900, such as a wireless communication device, is depicted. The device 900 includes a processor 910, such as a digital signal processor (DSP), coupled to a memory 932. The memory 932 includes instructions 968 (e.g., executable instructions), such as computer-readable instructions or processor-readable instructions. The instructions 968 may include one or more instructions that are executable by a computer, such as the processor 910.

FIG. 9 also shows a display controller 926 that is coupled to the processor 910 and to a display 928. A coder/decoder (CODEC) 934 can also be coupled to the processor 910. A speaker 936 and a microphone 938 can be coupled to the CODEC 934.

FIG. 9 also indicates that a wireless interface 940 can be coupled to the processor 910 and to an antenna 942. The wireless interface 940, or components thereof, may include a semiconductor device 964, such as the inductor structure 142 of FIG. 1, the inductor structure 200 of FIG. 2, the inductor structure 300 of FIG. 3, the inductor structure 400 of FIG. 4, the inductor structure 500 of FIG. 5, or the inductor structure 600 of FIG. 6.

In some implementations, the semiconductor device 964, the processor 910, the display controller 926, the memory 932, the CODEC 934, and the wireless interface 940 are included in a system-in-package or system-on-chip device 922. In some implementations, an input device 930 and a power supply 944 are coupled to the system-on-chip device 922. Moreover, in a particular aspect, as illustrated in FIG. 9, the display 928, the input device 930, the speaker 936, the microphone 938, the antenna 942, and the power supply 944 are external to the system-on-chip device 922. However, each of the display 928, the input device 930, the speaker 936, the microphone 938, the antenna 942, and the power supply 944 can be coupled to a component of the system-on-chip device 922, such as an interface or a controller. Although the semiconductor device 964 is depicted as being included in the wireless interface 940 (e.g., wireless controller), in other implementations, the semiconductor device 964 may be included in another component of the device 900 or a component coupled to the device 900. For example, the semiconductor device 964 may be included in the processor 910, the memory 932, the power supply 944, the input device 930, the display 928, the display controller 926, the CODEC 934, the speaker 936, or the microphone 938.

In conjunction with one or more of the described aspects of FIGS. 1-9, an apparatus is disclosed that may include a first means for conducting current. The first means for conducting may include the first trace 150, the second trace 152, the additional trace 194 of FIG. 1, one or more traces of the traces 212-218 of FIG. 2, one or more traces of the traces 312-318 of FIG. 3, one or more traces of the traces 410-430 of FIG. 4, one or more traces of the traces 502-518 of FIG. 5, one or more traces of the traces 602-616 of FIG. 6, one or more other structures configured to conduct current, or any combination thereof.

The apparatus may also include a second means for conducting current. The second means for conducting may include the third trace 160 of FIG. 1, one or more traces of the traces 242-246 of FIG. 2, one or more traces of the traces 342-346 of FIG. 3, one or more traces of the traces 440-458 of FIG. 4, one or more traces of the traces 562-578 of FIG. 5, one or more traces of the traces 662-678 of FIG. 6, one or more other structures configured to conduct current, or any combination.

The apparatus may also include a third means for conducting current. The third means for conducting may include the fourth trace 170 of FIG. 1, one or more traces of the traces 222-228 of FIG. 2, one or more traces of the traces 322-326 of FIG. 3, one or more traces of the traces 522-536 of FIG. 5, one or more traces of the traces 632-638 of FIG. 6, one or more other structures configured to conduct current, or any combination.

One or more of the disclosed aspects may be implemented in a system or an apparatus, such as the electronic device 900, that may include a communications device, a fixed location data unit, a mobile location data unit, a mobile phone, a cellular phone, a satellite phone, a computer, a tablet, a portable computer, a display device, a media player, or a desktop computer. Alternatively or additionally, the electronic device 900 may include a set top box, an entertainment unit, a navigation device, a personal digital assistant (PDA), a monitor, a computer monitor, a television, a tuner, a radio, a satellite radio, a music player, a digital music player, a portable music player, a video player, a digital video player, a digital video disc (DVD) player, a portable digital video player, a satellite, a vehicle, any other device that includes a processor or that stores or retrieves data or computer instructions, or a combination thereof. As another illustrative, non-limiting example, the system or the apparatus may include remote units, such as hand-held personal communication systems (PCS) units, portable data units such as global positioning system (GPS) enabled devices, meter reading equipment, or any other device that includes a processor or that stores or retrieves data or computer instructions, or any combination thereof.

Figure 10:
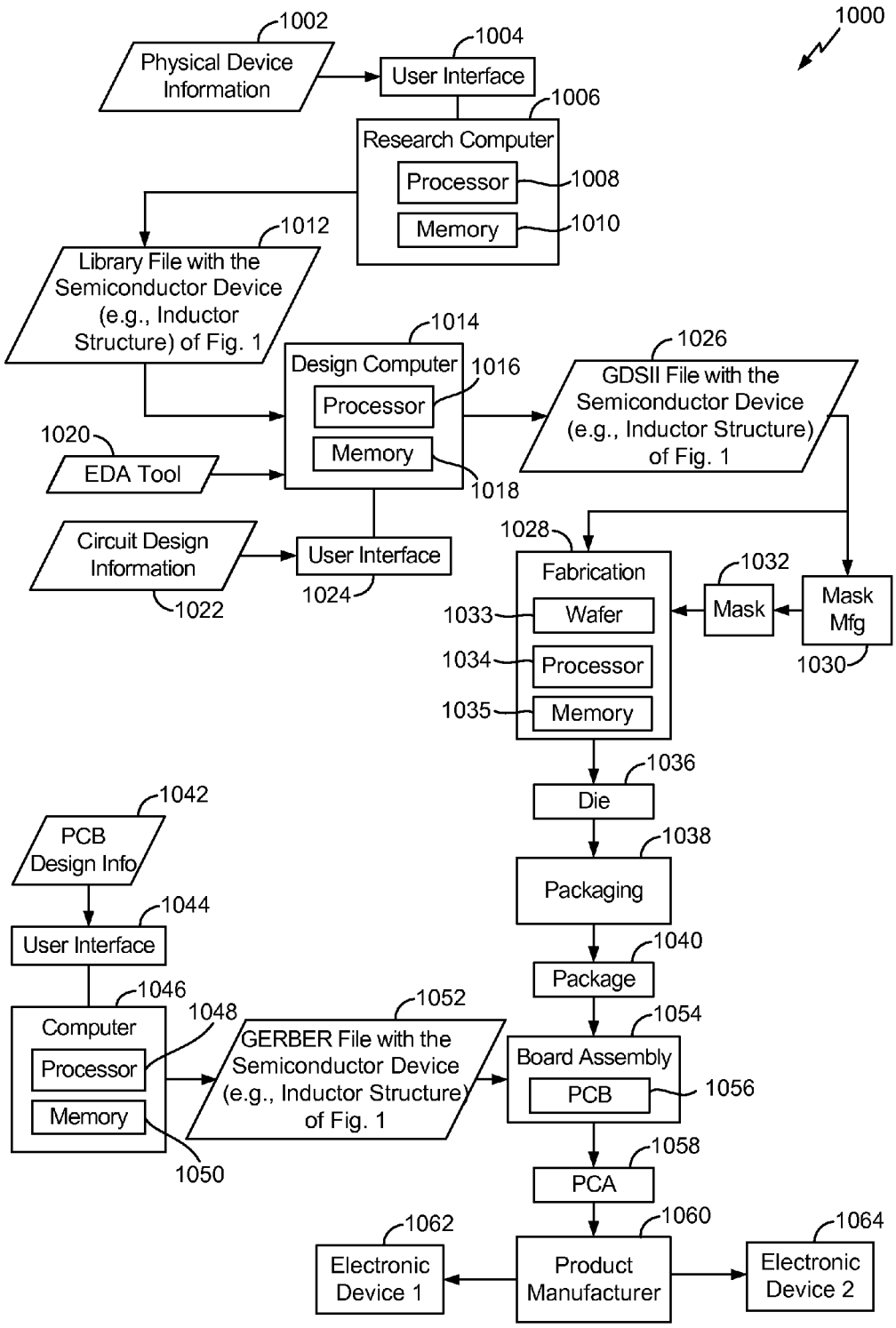
FIG. 10 is a data flow diagram of a particular illustrative aspect of a manufacturing process to manufacture electronic devices that include the inductor of FIG. 1.

The foregoing disclosed devices and functionalities may be designed and configured into computer files (e.g. RTL, GDSII, GERBER, etc.) stored on computer-readable media. Some or all such files may be provided to fabrication handlers who fabricate devices based on such files. Resulting products include semiconductor wafers that are then cut into semiconductor die and packaged into a semiconductor chip. The chips are then employed in devices described above. FIG. 10 depicts a particular illustrative aspect of an electronic device manufacturing process 1000.

Physical device information 1002 is received at the manufacturing process 1000, such as at a research computer 1006. The physical device information 1002 may include design information representing at least one physical property of the inductor structure 142 of FIG. 1, the inductor structure 200 of FIG. 2, the inductor structure 300 of FIG. 3, the inductor structure 400 of FIG. 4, the inductor structure 500 of FIG. 5, the inductor structure 600 of FIG. 6, a semiconductor device (e.g., an inductor structure) formed according to the method 700 of FIG. 7 and/or the method 800 of FIG. 8, or a combination thereof. For example, the physical device information 1002 may include physical parameters, material characteristics, and structure information that is entered via a user interface 1004 coupled to the research computer 1006. The research computer 1006 includes a processor 1008, such as one or more processing cores, coupled to a computer-readable medium (e.g., a non-transitory computer-readable medium), such as a memory 1010. The memory 1010 may store computer-readable instructions that are executable to cause the processor 1008 to transform the physical device information 1002 to comply with a file format and to generate a library file 1012.

In some implementations, the library file 1012 includes at least one data file including the transformed design information. For example, the library file 1012 may include a library of devices including a device that includes the inductor structure 142 of FIG. 1, the inductor structure 200 of FIG. 2, the inductor structure 300 of FIG. 3, the inductor structure 400 of FIG. 4, the inductor structure 500 of FIG. 5, the inductor structure 600 of FIG. 6, a semiconductor device (e.g., an inductor structure) formed according to the method 700 of FIG. 7 and/or the method 800 of FIG. 8, or a combination thereof, that is provided for use with an electronic design automation (EDA) tool 1020.

The library file 1012 may be used in conjunction with the EDA tool 1020 at a design computer 1014 including a processor 1016, such as one or more processing cores, coupled to a memory 1018. The EDA tool 1020 may be stored as processor executable instructions at the memory 1018 to enable a user of the design computer 1014 to design a circuit including the inductor structure 142 of FIG. 1, the inductor structure 200 of FIG. 2, the inductor structure 300 of FIG. 3, the inductor structure 400 of FIG. 4, the inductor structure 500 of FIG. 5, the inductor structure 600 of FIG. 6, a semiconductor device (e.g., an inductor structure) formed according to the method 700 of FIG. 7 and/or the method 800 of FIG. 8, or a combination thereof. For example, a user of the design computer 1014 may enter circuit design information 1022 via a user interface 1024 coupled to the design computer 1014.

The circuit design information 1022 may include design information representing at least one physical property of a component of the inductor structure 142 of FIG. 1, the inductor structure 200 of FIG. 2, the inductor structure 300 of FIG. 3, the inductor structure 400 of FIG. 4, the inductor structure 500 of FIG. 5, the inductor structure 600 of FIG. 6, a semiconductor device (e.g., an inductor structure) formed according to the method 700 of FIG. 7 and/or the method 800 of FIG. 8, or a combination thereof. To illustrate, the circuit design property may include identification of particular circuits and relationships to other elements in a circuit design, positioning information, feature size information, interconnection information, or other information representing a physical property of components of the inductor structure 142 of FIG. 1, the inductor structure 200 of FIG. 2, the inductor structure 300 of FIG. 3, the inductor structure 400 of FIG. 4, the inductor structure 500 of FIG. 5, the inductor structure 600 of FIG. 6, a semiconductor device (e.g., an inductor structure) formed according to the method 700 of FIG. 7 and/or the method 800 of FIG. 8, or a combination thereof.

The design computer 1014 may be configured to transform the design information, including the circuit design information 1022, to comply with a file format. To illustrate, the file format may include a database binary file format representing planar geometric shapes, text labels, and other information about a circuit layout in a hierarchical format, such as a Graphic Data System (GDSII) file format. The design computer 1014 may be configured to generate a data file including the transformed design information, such as a GDSII file 1026 that includes information describing the inductor structure 142 of FIG. 1, the inductor structure 200 of FIG. 2, the inductor structure 300 of FIG. 3, the inductor structure 400 of FIG. 4, the inductor structure 500 of FIG. 5, the inductor structure 600 of FIG. 6, a semiconductor device (e.g., an inductor structure) formed according to the method 700 of FIG. 7 and/or the method 800 of FIG. 8, or a combination thereof, in addition to other circuits or information. To illustrate, the data file may include information corresponding to a system-on-chip (SOC) that includes the inductor structure 142 of FIG. 1, the inductor structure 200 of FIG. 2, the inductor structure 300 of FIG. 3, the inductor structure 400 of FIG. 4, the inductor structure 500 of FIG. 5, the inductor structure 600 of FIG. 6, a semiconductor device (e.g., an inductor structure) formed according to the method 700 of FIG. 7 and/or the method 800 of FIG. 8, or a combination thereof, and that also includes additional electronic circuits and components within the SOC.

The GDSII file 1026 may be received at a fabrication process 1028 to manufacture the inductor structure 142 of FIG. 1, the inductor structure 200 of FIG. 2, the inductor structure 300 of FIG. 3, the inductor structure 400 of FIG. 4, the inductor structure 500 of FIG. 5, the inductor structure 600 of FIG. 6, a semiconductor device (e.g., an inductor structure) formed according to the method 700 of FIG. 7 and/or the method 800 of FIG. 8, or a combination thereof, according to transformed information in the GDSII file 1026. For example, a device manufacture process may include providing the GDSII file 1026 to a mask manufacturer 1030 to create one or more masks, such as masks to be used with photolithography processing, illustrated as a representative mask 1032. The mask 1032 may be used during the fabrication process to generate one or more wafers 1033, which may be tested and separated into dies, such as a representative die 1036. The die 1036 includes a circuit including a device that includes the inductor structure 142 of FIG. 1, the inductor structure 200 of FIG. 2, the inductor structure 300 of FIG. 3, the inductor structure 400 of FIG. 4, the inductor structure 500 of FIG. 5, the inductor structure 600 of FIG. 6, a semiconductor device (e.g., an inductor structure) formed according to the method 700 of FIG. 7 and/or the method 800 of FIG. 8, or a combination thereof.

For example, the fabrication process 1028 may include a processor 1034 and a memory 1035 to initiate and/or control the fabrication process 1028. The memory 1035 may include executable instructions such as computer-readable instructions or processor-readable instructions. The executable instructions may include one or more instructions that are executable by a computer such as the processor 1034.

The fabrication process 1028 may be implemented by a fabrication system that is fully automated or partially automated. For example, the fabrication process 1028 may be automated according to a schedule. The fabrication system may include fabrication equipment (e.g., processing tools) to perform one or more operations to form a semiconductor device, such as the inductor structure 142 of FIG. 1, the inductor structure 200 of FIG. 2, the inductor structure 300 of FIG. 3, the inductor structure 400 of FIG. 4, the inductor structure 500 of FIG. 5, the inductor structure 600 of FIG. 6, a semiconductor device (e.g., an inductor structure) formed according to the method 700 of FIG. 7 and/or the method 800 of FIG. 8, or a combination thereof. For example, the fabrication equipment may be configured to deposit one or more materials, etch one or more materials, etch one or more dielectric materials, perform a chemical mechanical planarization process, perform a thermal anneal, deposit a conductive material, perform a chemical vapor deposition (CVD) process, etc., or a combination thereof, as illustrative, non-limiting examples.

The fabrication system (e.g., an automated system that performs the fabrication process 1028) may have a distributed architecture (e.g., a hierarchy). For example, the fabrication system may include one or more processors, such as the processor 1034, one or more memories, such as the memory 1035, and/or controllers that are distributed according to the distributed architecture. The distributed architecture may include a high-level processor that controls or initiates operations of one or more low-level systems. For example, a high-level portion of the fabrication process 1028 may include one or more processors, such as the processor 1034, and the low-level systems may each include or may be controlled by one or more corresponding controllers. A particular controller of a particular low-level system may receive one or more instructions (e.g., commands) from a particular high-level system, may issue sub-commands to subordinate modules or process tools, and may communicate status data back to the particular high-level. Each of the one or more low-level systems may be associated with one or more corresponding pieces of fabrication equipment (e.g., processing tools). In some implementations, the fabrication system may include multiple processors that are distributed in the fabrication system. For example, a controller of a low-level system component may include a processor, such as the processor 1034.

Alternatively, the processor 1034 may be a part of a high-level system, subsystem, or component of the fabrication system. In another implementation, the processor 1034 includes distributed processing at various levels and components of a fabrication system.

Thus, the processor 1034 may include processor-executable instructions that, when executed by the processor 1034, cause the processor 1034 to initiate or control formation of an inductor, such as the inductor 140 of FIG. 1. For example, the executable instructions included in the memory 1035 may enable the processor 1034 to initiate formation of the inductor structure 142 of FIG. 1, the inductor structure 200 of FIG. 2, the inductor structure 300 of FIG. 3, the inductor structure 400 of FIG. 4, the inductor structure 500 of FIG. 5, the inductor structure 600 of FIG. 6, a semiconductor device (e.g., an inductor structure) formed according to the method 700 of FIG. 7 and/or the method 800 of FIG. 8, or a combination thereof. In some implementations, the memory 1035 is a non-transient computer-readable medium storing computer-executable instructions that are executable by the processor 1034 to cause the processor 1034 to initiate formation of a semiconductor device in accordance with at least a portion of the method 700 of FIG. 7 and/or the method 800 of FIG. 8, or any combination thereof. For example, the computer executable instructions may be executable to cause the processor 1034 to initiate or control formation of the inductor 140 of FIG. 1.

As an illustrative example, the processor 1034 may initiate or control forming a first set of traces corresponding to a first layer of an inductor. The first set of traces includes a first trace and a second trace that is parallel. A dimension of the first trace may be different from a corresponding dimension of the second trace. For example, the first trace may have a different length and/or width than the second trace. In some implementations, a first length and a first width of the first trace may each be different from a second length and a second width of the second trace. The processor 1034 may further initiate or control forming a second set of traces corresponding to a second layer of the inductor. The second set of traces coupled to the first set of traces. The second set of traces includes a third trace that is coupled to the first trace and to the second trace. The processor 1034 may further initiate or control forming a third set of traces corresponding to a third layer of the inductor that is positioned between the first layer and the second layer. The third set of traces may be coupled to the first set of traces.

As another illustrative example, the processor 1034 may initiate or control forming a first set of traces corresponding to a first layer of an inductor. The first set of traces may include a first sub-set of traces and a second sub-set of traces. Each trace of the first sub-set of traces is parallel to the other traces of the first sub-set of traces. At least one trace of the second sub-set of traces is non-parallel to each trace of the first sub-set of traces. The processor 1034 may further initiate or control forming a second set of traces corresponding to a second layer of the inductor, the second set of traces including a third sub-set of traces and a fourth sub-set of traces, where each trace of the third sub-set of traces is parallel to the other traces of the third sub-set of traces. At least one trace of the fourth sub-set of traces is non-parallel to each trace of the third sub-set of traces.

The die 1036 may be provided to a packaging process 1038 where the die 1036 is incorporated into a representative package 1040. For example, the package 1040 may include the single die 1036 or multiple dies, such as a system-in-package (SiP) arrangement. For example, the package 1040 may include or correspond to the system in package or system-on-chip device 922 of FIG. 9. The package 1040 may be configured to conform to one or more standards or specifications, such as Joint Electron Device Engineering Council (JEDEC) standards.

Information regarding the package 1040 may be distributed to various product designers, such as via a component library stored at a computer 1046. The computer 1046 may include a processor 1048, such as one or more processing cores, coupled to a memory 1050. A printed circuit board (PCB) tool may be stored as processor executable instructions at the memory 1050 to process PCB design information 1042 received from a user of the computer 1046 via a user interface 1044. The PCB design information 1042 may include physical positioning information of a packaged semiconductor device on a circuit board, the packaged semiconductor device including the inductor structure 142 of FIG. 1, the inductor structure 200 of FIG. 2, the inductor structure 300 of FIG. 3, the inductor structure 400 of FIG. 4, the inductor structure 500 of FIG. 5, the inductor structure 600 of FIG. 6, a semiconductor device (e.g., an inductor structure) formed according to the method 700 of FIG. 7 and/or the method 800 of FIG. 8, or a combination thereof.

The computer 1046 may be configured to transform the PCB design information 1042 to generate a data file, such as a GERBER file 1052 with data that includes physical positioning information of a packaged semiconductor device on a circuit board, as well as layout of electrical connections such as traces (e.g., metal lines) and vias (e.g., via structures), where the packaged semiconductor device corresponds to the package 1040 including the inductor structure 142 of FIG. 1, the inductor structure 200 of FIG. 2, the inductor structure 300 of FIG. 3, the inductor structure 400 of FIG. 4, the inductor structure 500 of FIG. 5, the inductor structure 600 of FIG. 6, a semiconductor device (e.g., an inductor structure) formed according to the method 700 of FIG. 7 and/or the method 800 of FIG. 8, or a combination thereof. In other implementations, the data file generated by the transformed PCB design information may have a format other than a GERBER format.

The GERBER file 1052 may be received at a board assembly process 1054 and used to create PCBs, such as a representative PCB 1056, manufactured in accordance with the design information stored within the GERBER file 1052. For example, the GERBER file 1052 may be uploaded to one or more machines to perform various steps of a PCB production process. The PCB 1056 may be populated with electronic components including the package 1040 to form a representative printed circuit assembly (PCA) 1058.

The PCA 1058 may be received at a product manufacture process 1060 and integrated into one or more electronic devices, such as a first representative electronic device 1062 and a second representative electronic device 1064. For example, the first representative electronic device 1062, the second representative electronic device 1064, or both, may include the device 900 of FIG. 9. As an illustrative, non-limiting example, the first representative electronic device 1062, the second representative electronic device 1064, or both, may include a communications device, a fixed location data unit, a mobile location data unit, a mobile phone, a cellular phone, a satellite phone, a computer, a tablet, a portable computer, or a desktop computer, into which the inductor structure 142 of FIG. 1, the inductor structure 200 of FIG. 2, the inductor structure 300 of FIG. 3, the inductor structure 400 of FIG. 4, the inductor structure 500 of FIG. 5, the inductor structure 600 of FIG. 6, a semiconductor device (e.g., an inductor structure) formed according to the method 700 of FIG. 7 and/or the method 800 of FIG. 8, or a combination thereof, is integrated.

Alternatively or additionally, the first representative electronic device 1062, the second representative electronic device 1064, or both, may include a set top box, an entertainment unit, a navigation device, a personal digital assistant (PDA), a monitor, a computer monitor, a television, a tuner, a radio, a satellite radio, a music player, a digital music player, a portable music player, a video player, a digital video player, a digital video disc (DVD) player, a portable digital video player, any other device that includes a processor or that stores or retrieves data or computer instructions, or a combination thereof, into which the inductor structure 142 of FIG. 1, the inductor structure 200 of FIG. 2, the inductor structure 300 of FIG. 3, the inductor structure 400 of FIG. 4, the inductor structure 500 of FIG. 5, the inductor structure 600 of FIG. 6, a semiconductor device (e.g., an inductor structure) formed according to the method 700 of FIG. 7 and/or the method 800 of FIG. 8, or a combination thereof, is integrated. As another illustrative, non-limiting example, one or more of the electronic devices 1062 and 1064 may include remote units, such as mobile phones, hand-held personal communication systems (PCS) units, portable data units such as personal data assistants, global positioning system (GPS) enabled devices, navigation devices, fixed location data units such as meter reading equipment, any other device that includes a processor or that stores or retrieves data or computer instructions, or any combination thereof. Although FIG. 10 illustrates remote units according to teachings of the disclosure, the disclosure is not limited to these illustrated units. Aspects of the disclosure may be suitably employed in any device which includes active integrated circuitry including memory and on-chip circuitry.

A device that includes the inductor structure 142 of FIG. 1, the inductor structure 200 of FIG. 2, the inductor structure 300 of FIG. 3, the inductor structure 400 of FIG. 4, the inductor structure 500 of FIG. 5, the inductor structure 600 of FIG. 6, a semiconductor device (e.g., an inductor structure) formed according to the method 700 of FIG. 7 and/or the method 800 of FIG. 8, or a combination thereof, may be fabricated, processed, and incorporated into an electronic device, as described in the illustrative process 1000. One or more aspects disclosed with respect to FIGS. 1-10 may be included at various processing stages, such as within the library file 1012, the GDSII file 1026 (e.g., a file having a GDSII format), and the GERBER file 1052 (e.g., a file having a GERBER format), as well as stored at the memory 1010 of the research computer 1006, the memory 1018 of the design computer 1014, the memory 1050 of the computer 1046, the memory of one or more other computers or processors (not shown) used at the various stages, such as at the board assembly process 1054, and also incorporated into one or more other physical aspects such as the mask 1032, the die 1036, the package 1040, the PCA 1058, other products such as prototype circuits or devices (not shown), or any combination thereof. Although various representative stages of production from a physical device design to a final product are depicted, in other implementations fewer stages may be used or additional stages may be included. Similarly, the process 1000 may be performed by a single entity or by one or more entities performing various stages of the process 1000.

Although one or more of FIGS. 1-10 may illustrate systems, apparatuses, and/or methods according to the teachings of the disclosure, the disclosure is not limited to these illustrated systems, apparatuses, and/or methods. One or more functions or components of any of FIGS. 1-10 as illustrated or described herein may be combined with one or more other portions of another of FIGS. 1-10. Accordingly, no single aspect or single example described herein should be construed as limiting and aspects and/or examples of the disclosure may be suitably combined without departing from the teachings of the disclosure.

Those of skill would further appreciate that the various illustrative logical blocks, configurations, modules, circuits, and algorithm steps described in connection with the aspects disclosed herein may be implemented as electronic hardware, computer software executed by a processor, or combinations of both. Various illustrative components, blocks, configurations, modules, circuits, and steps have been described above generally in terms of their functionality. Whether such functionality is implemented as hardware or processor executable instructions depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the aspects disclosed herein may be embodied directly in hardware, in a software module executed by a processor, or in a combination of the two. A software module may reside in random access memory (RAM), flash memory, read-only memory (ROM), programmable read-only memory (PROM), erasable programmable read-only memory (EPROM), electrically erasable programmable read-only memory (EEPROM), registers, hard disk, a removable disk, a compact disc read-only memory (CD-ROM), or any other form of non-transient storage medium known in the art. For example, a storage medium may be coupled to the processor such that the processor can read information from, and write information to, the storage medium. In the alternative, the storage medium may be integral to the processor. The processor and the storage medium may reside in an application-specific integrated circuit (ASIC). The ASIC may reside in a computing device or a user terminal. In the alternative, the processor and the storage medium may reside as discrete components in a computing device or user terminal.

The previous description of the disclosed aspects is provided to enable a person skilled in the art to make or use the disclosed aspects. Various modifications to these aspects will be readily apparent to those skilled in the art, and the principles defined herein may be applied to other aspects without departing from the scope of the disclosure. Thus, the present disclosure is not intended to be limited to the aspects shown herein but is to be accorded the widest scope possible consistent with the principles and novel features as defined by the following claims.

What is claimed is:

1. An inductor structure comprising:

a first set of traces corresponding to a first layer of an inductor, wherein the first set of traces includes a first trace and a second trace, wherein the first trace is parallel to the second trace, and wherein a dimension of the first trace is different from a corresponding dimension of the second trace;

a second set of traces corresponding to a second layer of the inductor, the second set of traces coupled to the first set of traces, wherein the second set of traces includes a third trace, and wherein the third trace is coupled to the first trace and to the second trace; and a third set of traces corresponding to a third layer of the inductor, the third set of traces coupled to the first set of traces, wherein the third layer is positioned between the first layer and the second layer.

2. The inductor structure of claim 1, wherein the dimension of the first trace comprises a length.

3. The inductor structure of claim 1, wherein the dimension of the first trace comprises a width.

4. The inductor structure of claim 1, wherein the third set of traces further includes a fourth trace and a fifth trace, wherein the fourth trace is coupled to the second trace, wherein the fourth trace is parallel to the fifth trace, and wherein the fourth trace and the fifth trace have different lengths.

5. The inductor structure of claim 4, wherein the first trace at least partially overlaps the fifth trace, and wherein the second trace at least partially overlaps the fourth trace.

6. The inductor structure of claim 1, further comprising a fourth set of traces corresponding to a fourth layer of the inductor, the fourth set of traces coupled to the third set of traces, and wherein the fourth layer is positioned between the first layer and the second layer.

7. The inductor structure of claim 6, wherein the fourth set of traces includes a sixth trace and a seventh trace, wherein the sixth trace is parallel to the seventh trace, and wherein the third trace is coupled to the sixth trace and to the seventh trace.

8. The inductor structure of claim 1, wherein the first set of traces further includes an additional trace that is parallel to the first trace and the second trace, wherein the second trace is positioned between the first trace and the additional trace, and wherein the corresponding dimension of the second trace is greater than the dimension of the first trace and less than a second corresponding dimension of the additional trace.

9. The inductor structure of claim 1, wherein the first set of traces further includes an eighth trace that is parallel to the first trace and to the second trace, wherein the second trace is positioned between the first trace and the eighth trace, wherein the first trace and the second trace are a first distance apart, wherein the second trace and the eighth trace are a second distance apart, and wherein the first distance is different from the second distance.

10. The inductor structure of claim 1, wherein the first set of traces comprises multiple traces, wherein each trace of the multiple traces has a different length, and wherein the first set of traces have a tapered configuration.

11. The inductor structure of claim 1, wherein the dimension comprises a length, and wherein a first width of the first trace is different from a second width of the second trace.

12. The inductor structure of claim 11, wherein the dimension of the first trace is less than the corresponding dimension of the second trace, and wherein the first width is less than the second width.

13. The inductor structure of claim 1, wherein the first set of traces comprises a first sub-set of traces and a second sub-set of traces, wherein each trace of the first sub-set of traces is parallel to other traces of the first sub-set of traces, and wherein each trace of the second sub-set of traces is non-parallel to other traces of the second sub-set of traces.

14. The inductor structure of claim 13, wherein the second set of traces comprises a third sub-set of traces and a fourth sub-set of traces, wherein each trace of the third sub-set of traces is parallel to other traces of the third sub-set of traces, and wherein each trace of the fourth sub-set of traces is non-parallel to other traces of the fourth sub-set of traces.

15. An apparatus comprising:

first means for conducting current corresponding to a first layer of an inductor, wherein the first means for conducting current includes a first trace and a second trace, wherein the first trace is parallel to the second trace, and wherein a dimension of the first trace is different from a corresponding dimension of the second trace;

second means for conducting current corresponding to a second layer of the inductor, the second means for conducting current coupled to the first means for conducting current, wherein the second means for conducting current includes a third trace, and wherein the third trace is coupled to the first trace and to the second trace; and third means for conducting current corresponding to a third layer of the inductor, the third means for conducting current coupled to the first means for conducting current, wherein the third layer is positioned between the first layer and the second layer.

16. The apparatus of claim 15, further comprising:

first means for coupling the first means for conducting current to the third means for conducting current; and second means for coupling the first means for conducting current to the second means for conducting current.

17. The apparatus of claim 16, wherein the second means for coupling includes a single connector.

18. The apparatus of claim 15, further comprising:

fourth means for conducting current corresponding to a fourth layer of the inductor, the fourth means for conducting current coupled to the third means for conducting current, wherein the fourth layer is positioned between the first layer and the second layer; and third means for coupling the third means for conducting current to the fourth means for conducting current.

19. An inductor structure comprising:

a first set of traces corresponding to a first layer of an inductor, the first set of traces including a first sub-set of traces and a second sub-set of traces, wherein each trace of the first sub-set of traces is parallel to other traces of the first sub-set of traces, and wherein at least one trace of the second sub-set of traces is non-parallel to each trace of the first sub-set of traces; and a second set of traces corresponding to a second layer of the inductor, the second set of traces including a third sub-set of traces and a fourth sub-set of traces, wherein each trace of the third sub-set of traces is parallel to other traces of the third sub-set of traces, and wherein at least one trace of the fourth sub-set of traces is non-parallel to each trace of the third sub-set of traces.

20. The inductor structure of claim 19, further comprising a first set of connectors, wherein the first set of connectors include a first sub-set of connectors and a second sub-set of connectors, wherein the first sub-set of connectors is configured to couple the first sub-set of traces to the fourth sub-set of traces, and wherein the second sub-set of connectors is configured to couple the second sub-set of traces to the third sub-set of traces.

21. The inductor structure of claim 20, wherein a particular connector of the first set of connectors comprises a through glass via, a bump, or a combination thereof.

22. The inductor structure of claim 19, wherein the first set of traces is formed on a first surface of a first device, and wherein the second set of traces is formed on a second surface of a second device.

23. The inductor structure of claim 19, further comprising:

a third set of traces corresponding to a third layer of the inductor, the third set of traces including a fifth sub-set of traces and a sixth sub-set of traces, wherein each trace of the fifth sub-set of traces is parallel to other traces of the fifth sub-set of traces, and wherein at least one trace of the sixth sub-set of traces is non-parallel to each trace of the fifth sub-set of traces; and a fourth set of traces corresponding to a fourth layer of the inductor, the fourth set of traces including a seventh sub-set of traces and an eighth sub-set of traces, wherein each trace of the seventh sub-set of traces is parallel to other traces of the seventh sub-set of traces, and wherein at least one trace of the eighth sub-set of traces is non-parallel to each trace of the seventh sub-set of traces.

24. The inductor structure of claim 23, further comprising a first set of connectors configured to couple the first set of traces and the second set of traces;

a second set of connectors configured to couple the third set of traces and the fourth set of traces; and a connector configured to couple a first particular trace of the first set of traces to a second particular trace of the third set of traces.

25. A method of forming an inductor structure, the method comprising:

forming a first set of traces corresponding to a first layer of an inductor, wherein the first set of traces includes a first trace and a second trace, wherein the first trace is parallel to the second trace, and wherein a dimension of the first trace is different from a corresponding dimension of the second trace;

forming a second set of traces corresponding to a second layer of the inductor, the second set of traces coupled to the first set of traces, wherein the second set of traces includes a third trace, and wherein the third trace is coupled to the first trace and to the second trace; and forming a third set of traces corresponding to a third layer of the inductor, the third set of traces coupled to the first set of traces, wherein the third layer is positioned between the first layer and the second layer.

26. The method of claim 25, further comprising:

forming a first set of connectors configured to couple the first set of traces to the third set of traces; and forming a second set of connectors configured to couple the first set of traces to the second set of traces.

27. The method of claim 26, wherein at least one connector of the second set of connectors includes a through glass via, a bump, or a combination thereof.

28. The method of claim 25, wherein the third set of traces includes a fourth trace and a fifth trace, and wherein the fourth trace is parallel to the fifth trace.

29. The method of claim 26, further comprising:

forming a fourth set of traces corresponding to a fourth layer of the inductor, wherein the fourth layer is positioned between the first layer and the second layer; and forming a third set of connectors configured to couple the third set of traces to the fourth set of traces.

30. The method of claim 29, wherein the third layer is positioned between the first layer and the fourth layer, wherein the fourth set of traces includes a sixth trace and a seventh trace, and wherein the sixth trace is parallel to the seventh trace.

* * * * *